US012808114B2

(12) United States Patent
Sang et al.

(10) Patent No.: US 12,808,114 B2
(45) Date of Patent: Nov. 24, 2026

(54) LAUNDRY TREATING APPARATUS

(71) Applicant: LG ELECTRONICS INC., Seoul (KR)

(72) Inventors: Minkyu Sang, Seoul (KR); Kyuchul Lee, Seoul (KR); Dosu Kim, Seoul (KR); Soonchang Hong, Seoul (KR); Seungwan Go, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 132 days.

(21) Appl. No.: 18/821,892

(22) Filed: Aug. 30, 2024

(65) Prior Publication Data

US 2025/0075409 A1 Mar. 6, 2025

(30) Foreign Application Priority Data

Aug. 31, 2023 (KR) ..... 10-2023-0115799

(51) Int. Cl.

| | |
|---|---|
| ***D06F 39/14*** | (2006.01) |
| ***D06F 23/02*** | (2006.01) |
| ***D06F 23/04*** | (2006.01) |
| ***D06F 25/00*** | (2006.01) |
| ***D06F 34/04*** | (2020.01) |
| ***D06F 34/20*** | (2020.01) |

(Continued)

(52) U.S. Cl.

CPC ..... *D06F 39/14* (2013.01); *D06F 23/02* (2013.01); *D06F 23/04* (2013.01); *D06F 25/00* (2013.01); *D06F 34/04* (2020.02); *D06F 34/20* (2020.02); *D06F 34/32* (2020.02); *D06F 58/02* (2013.01); *D06F 58/20* (2013.01); *D06F 2103/40* (2020.02); *D06F 2105/44* (2020.02)

(58) Field of Classification Search

CPC ..... D06F 23/02; D06F 23/04; D06F 25/00; D06F 34/04; D06F 34/20; D06F 34/32; D06F 37/28; D06F 37/42; D06F 39/14; D06F 58/02; D06F 58/20; D06F 2103/40; D06F 2105/44

See application file for complete search history.

(56) References Cited

U.S. PATENT DOCUMENTS

2006/0123855 A1* 6/2006 Erickson ..... D06F 39/14 68/196
2016/0002841 A1* 1/2016 Kim ..... D06F 39/088 68/23.5

(Continued)

FOREIGN PATENT DOCUMENTS

EP 3 358 066 A1 8/2018
JP 2022-540294 A 9/2022

(Continued)

OTHER PUBLICATIONS

Machine Translation of Kwon et al., KR-20170082110-A, Jul. 2017. (Year: 2017).*

*Primary Examiner* — David G Cormier
(74) *Attorney, Agent, or Firm* — Birch, Stewart, Kolasch & Birch, LLP

(57) ABSTRACT

Disclosed is a laundry treating apparatus including a lock disposed on a cabinet to selectively lock a door to the cabinet, and a sensor disposed in the door to receive an opening command for the door to open an inlet, wherein the lock is controlled to unlock the door when the sensor receives the opening command.

13 Claims, 17 Drawing Sheets

(51) Int. Cl.

| | |
|---|---|
| ***D06F 34/32*** | (2020.01) |
| ***D06F 58/02*** | (2006.01) |
| ***D06F 58/20*** | (2006.01) |
| *D06F 103/40* | (2020.01) |
| *D06F 105/44* | (2020.01) |

(56) References Cited

U.S. PATENT DOCUMENTS

| | | | | |
|---|---|---|---|---|
| 2016/0201251 | A1* | 7/2016 | Zhang | D06F 39/14 700/275 |
| 2018/0216381 | A1 | 8/2018 | Lee et al. | |
| 2018/0363188 | A1 | 12/2018 | Gim | |

FOREIGN PATENT DOCUMENTS

| | | | | | |
|---|---|---|---|---|---|
| KR | 10-1409957 | B1 | | 6/2014 | |
| KR | 10-2016-0042932 | A | | 4/2016 | |
| KR | 10-2017-0051148 | A | | 5/2017 | |
| KR | 20170082110 | A | * | 7/2017 | E05D 5/10 |
| KR | 10-1821209 | B1 | | 1/2018 | |
| KR | 10-2018-0053198 | A | | 5/2018 | |
| KR | 10-2018-0090005 | A | | 8/2018 | |
| KR | 10-2018-0136101 | A | | 12/2018 | |

* cited by examiner

【FIG 1】
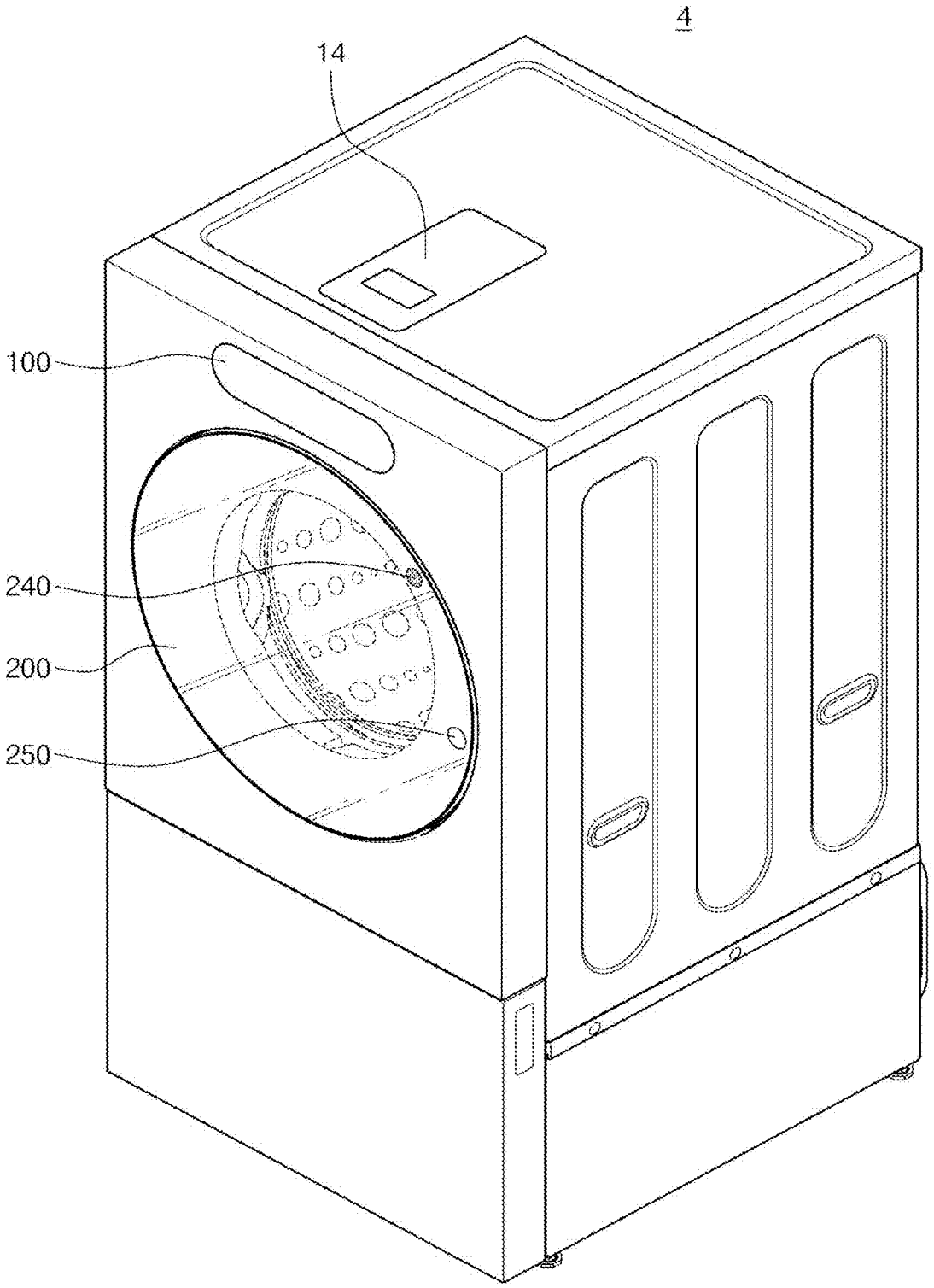

【FIG 2】
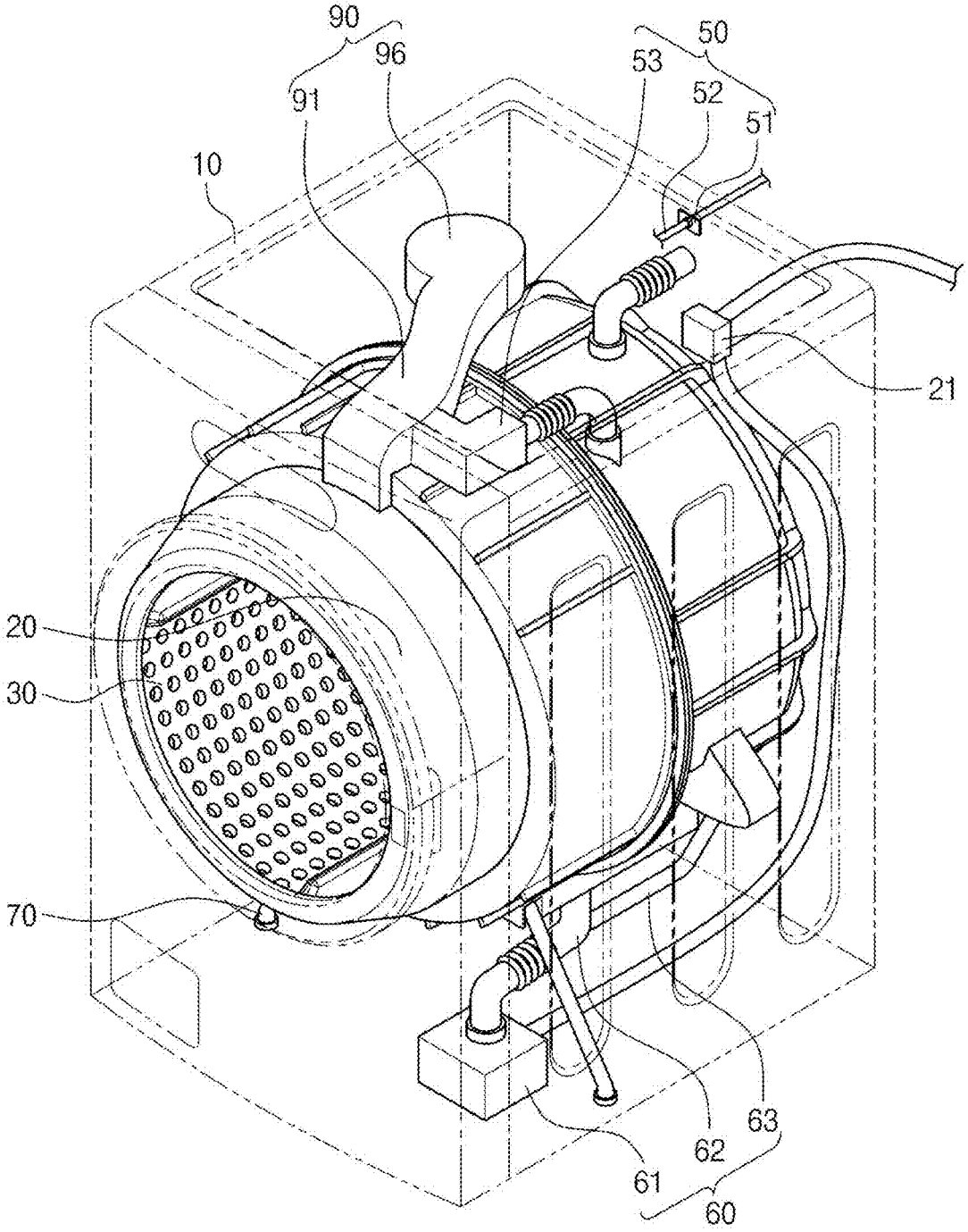

【FIG 3】
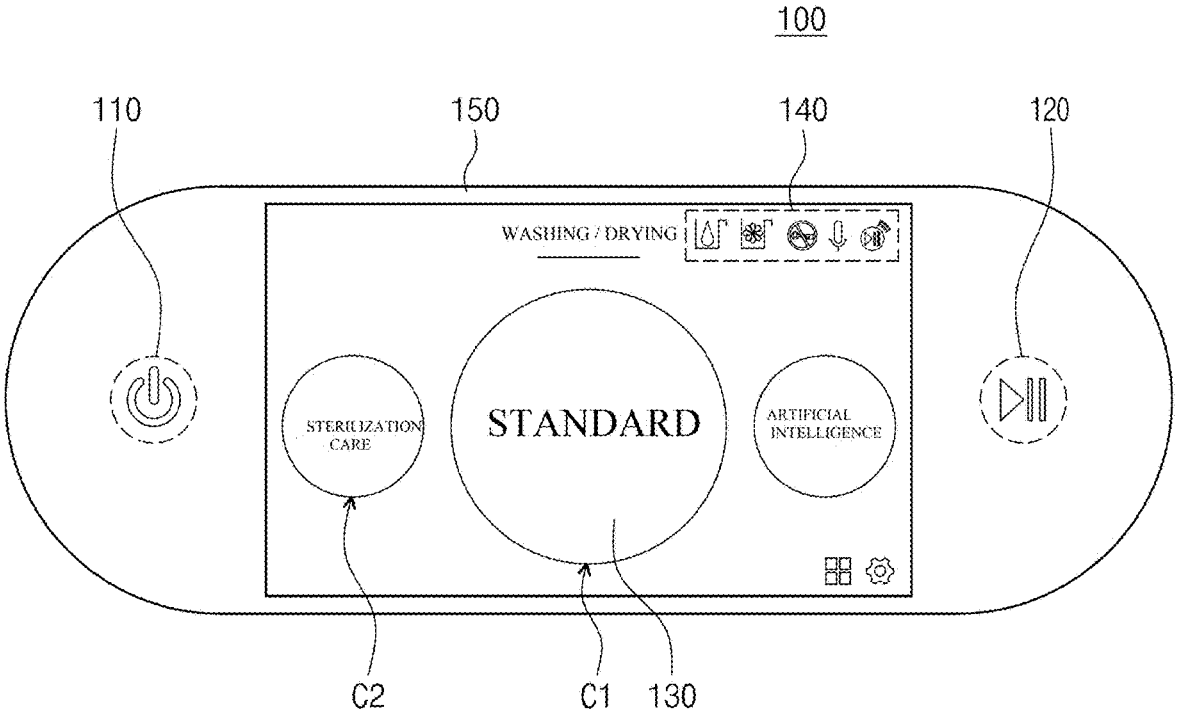

【FIG 4】
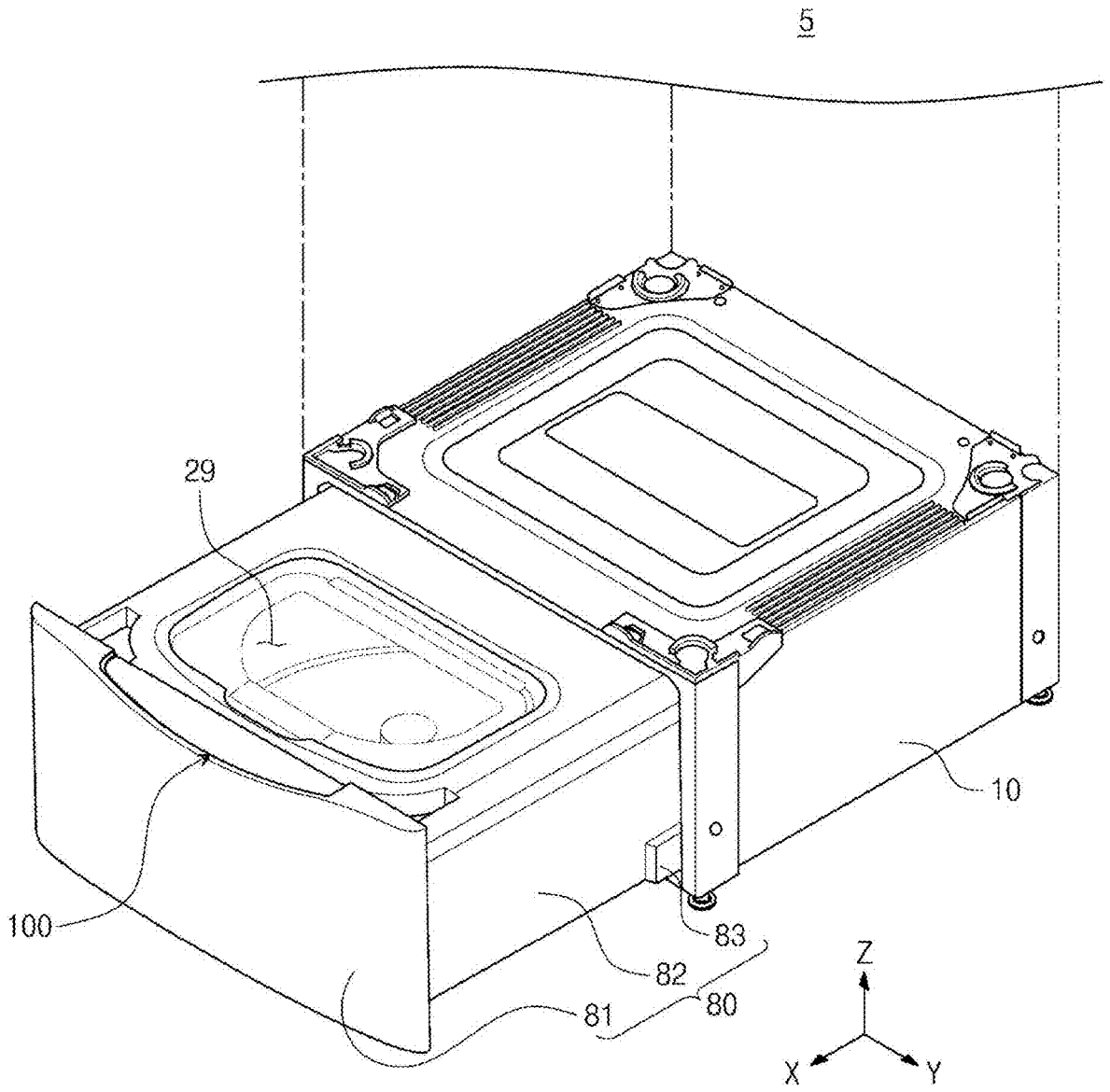

【FIG 5】
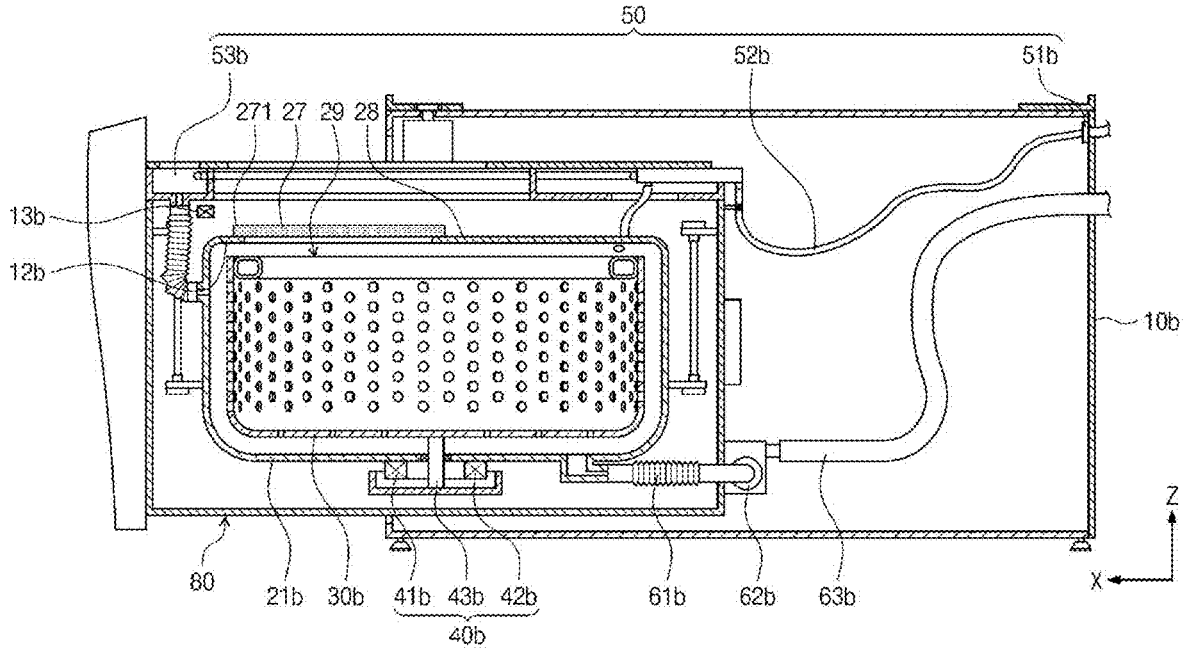
【FIG 6】
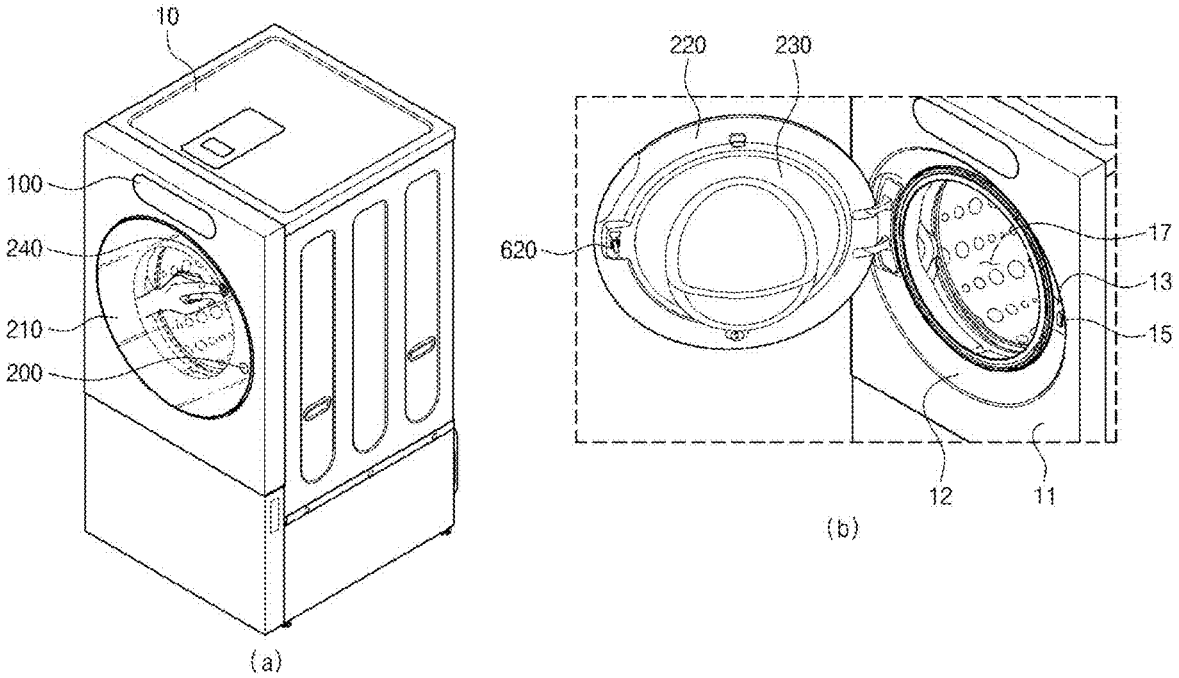

【FIG 7】
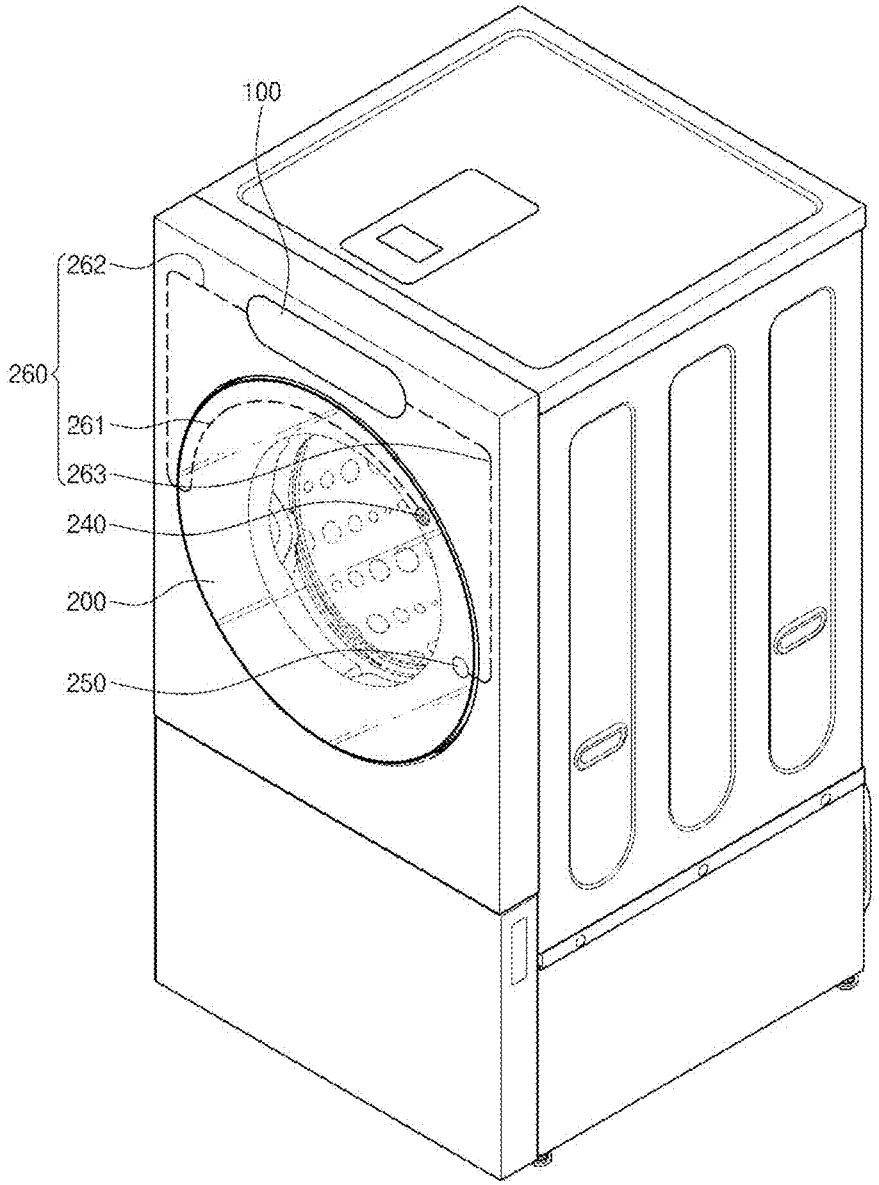

【FIG 8】
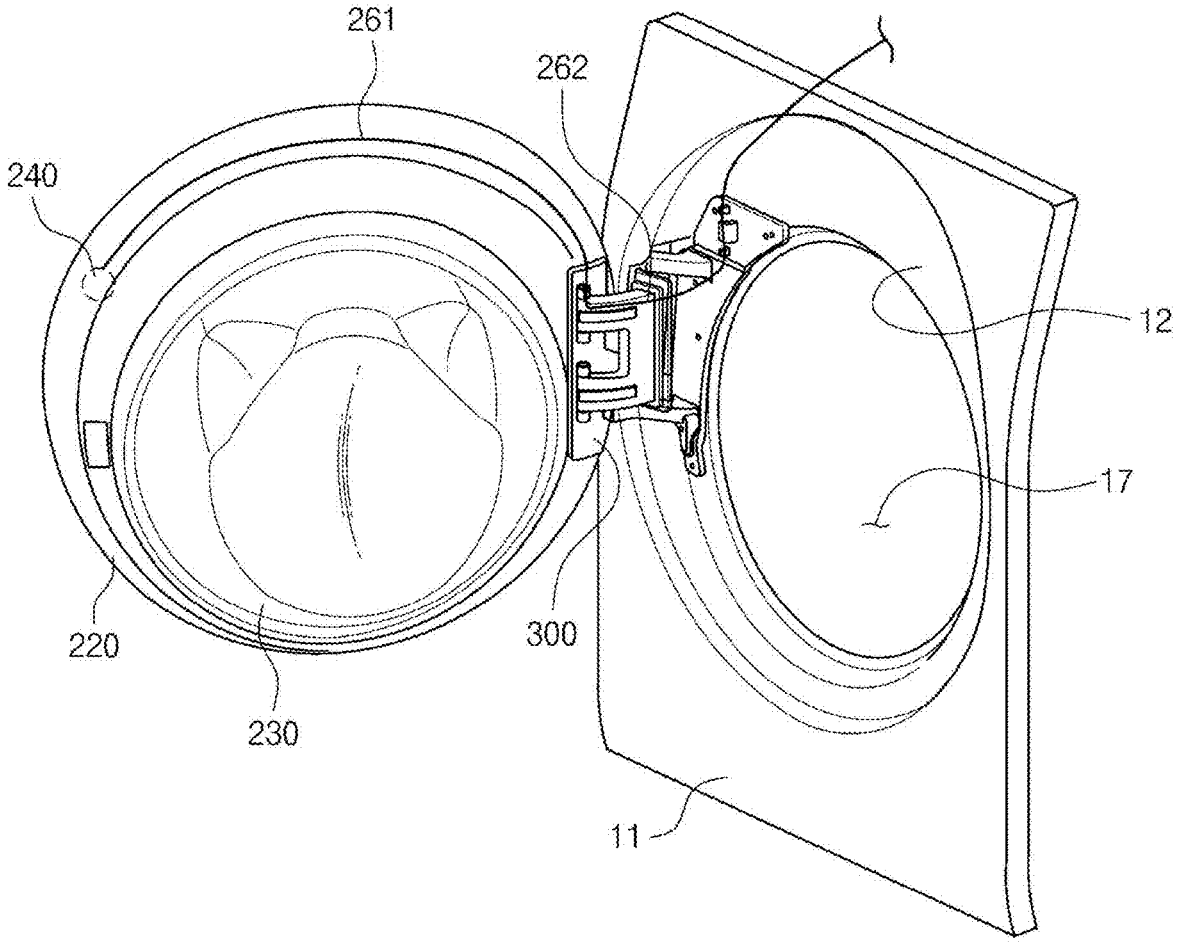

【FIG 9】
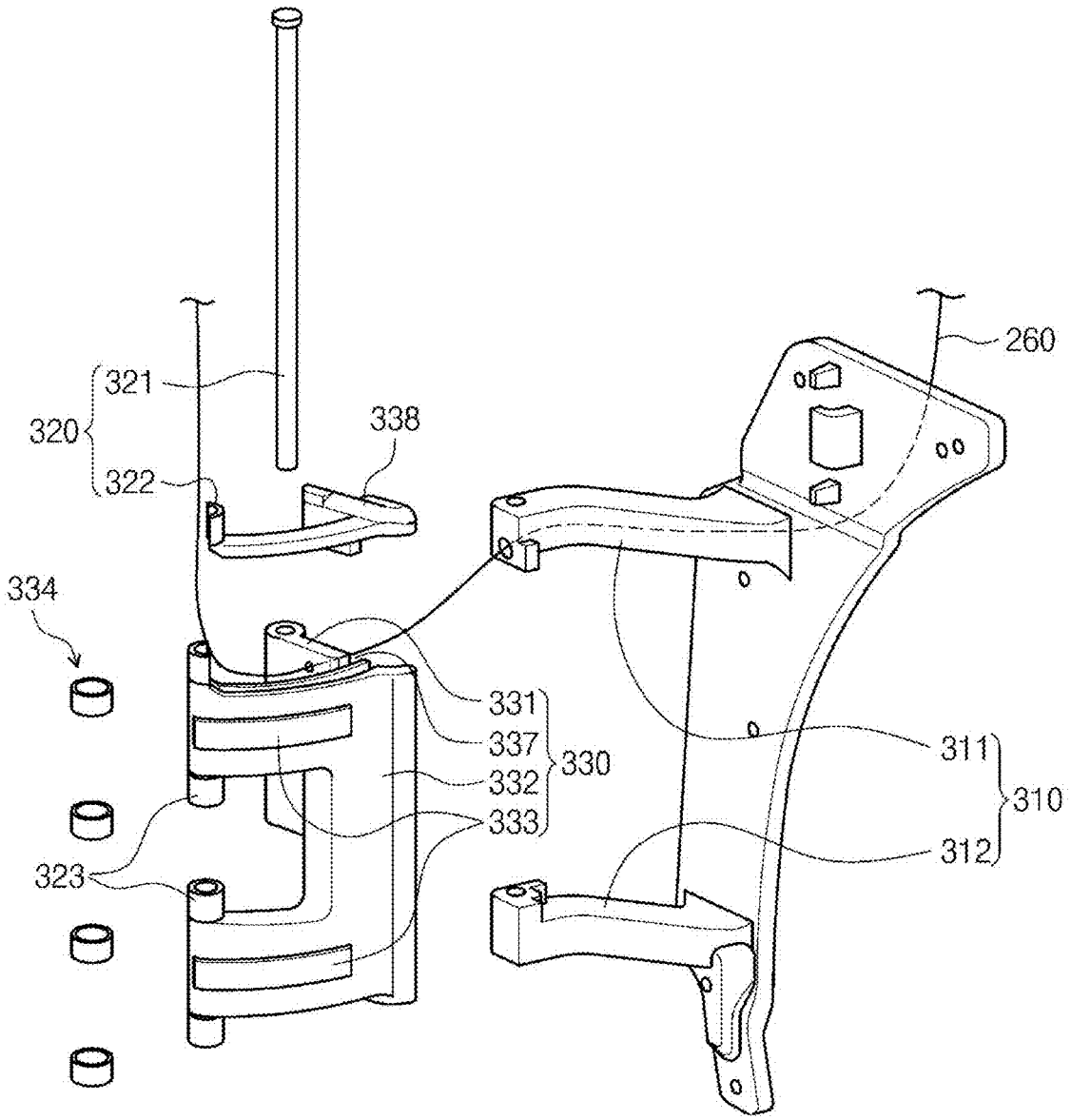

【FIG 10】
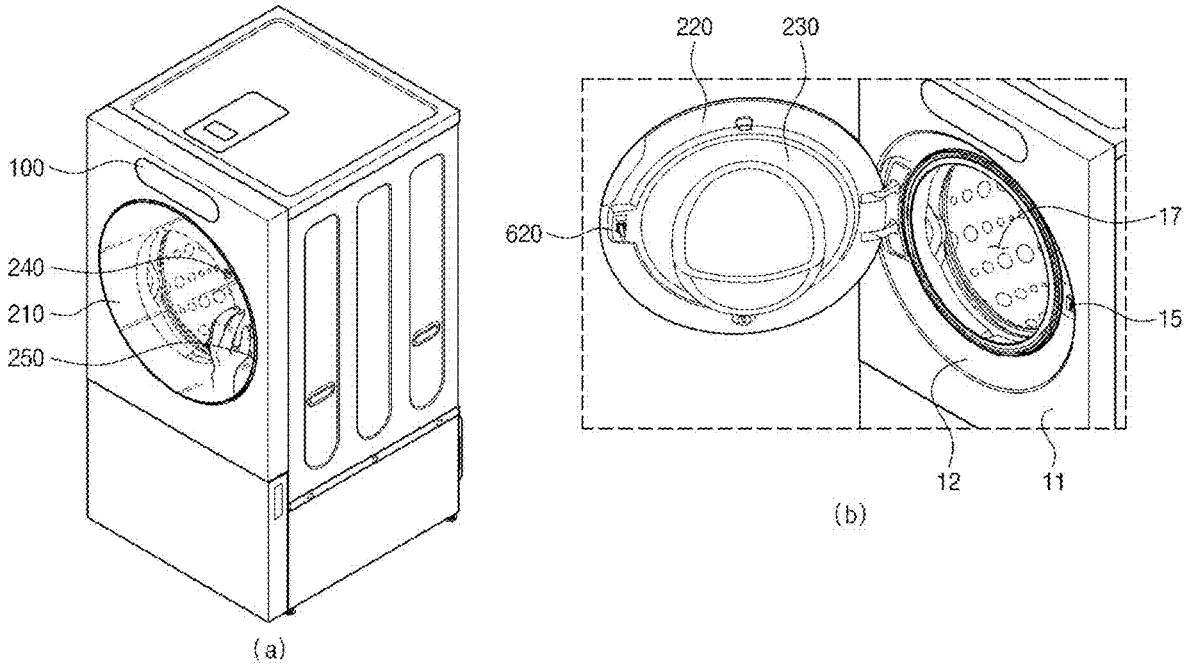

【FIG 11】
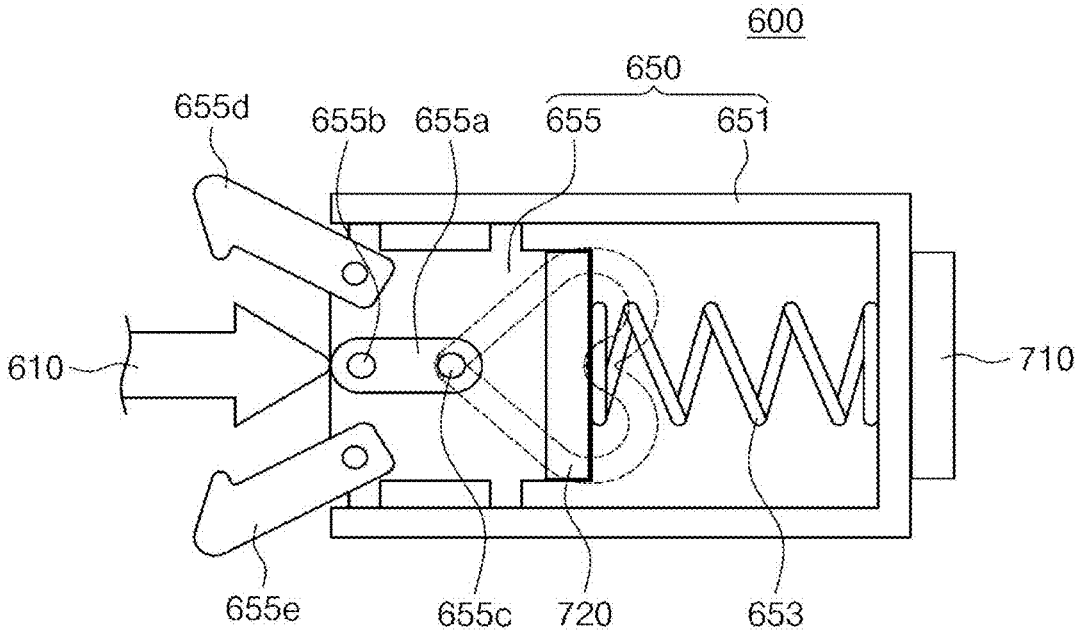
(a)
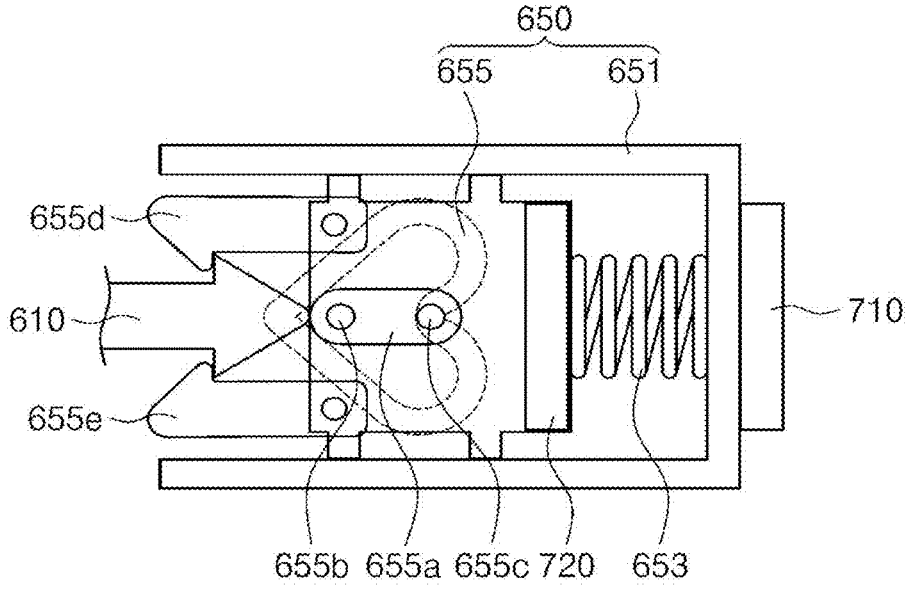
(b)

【FIG 12】
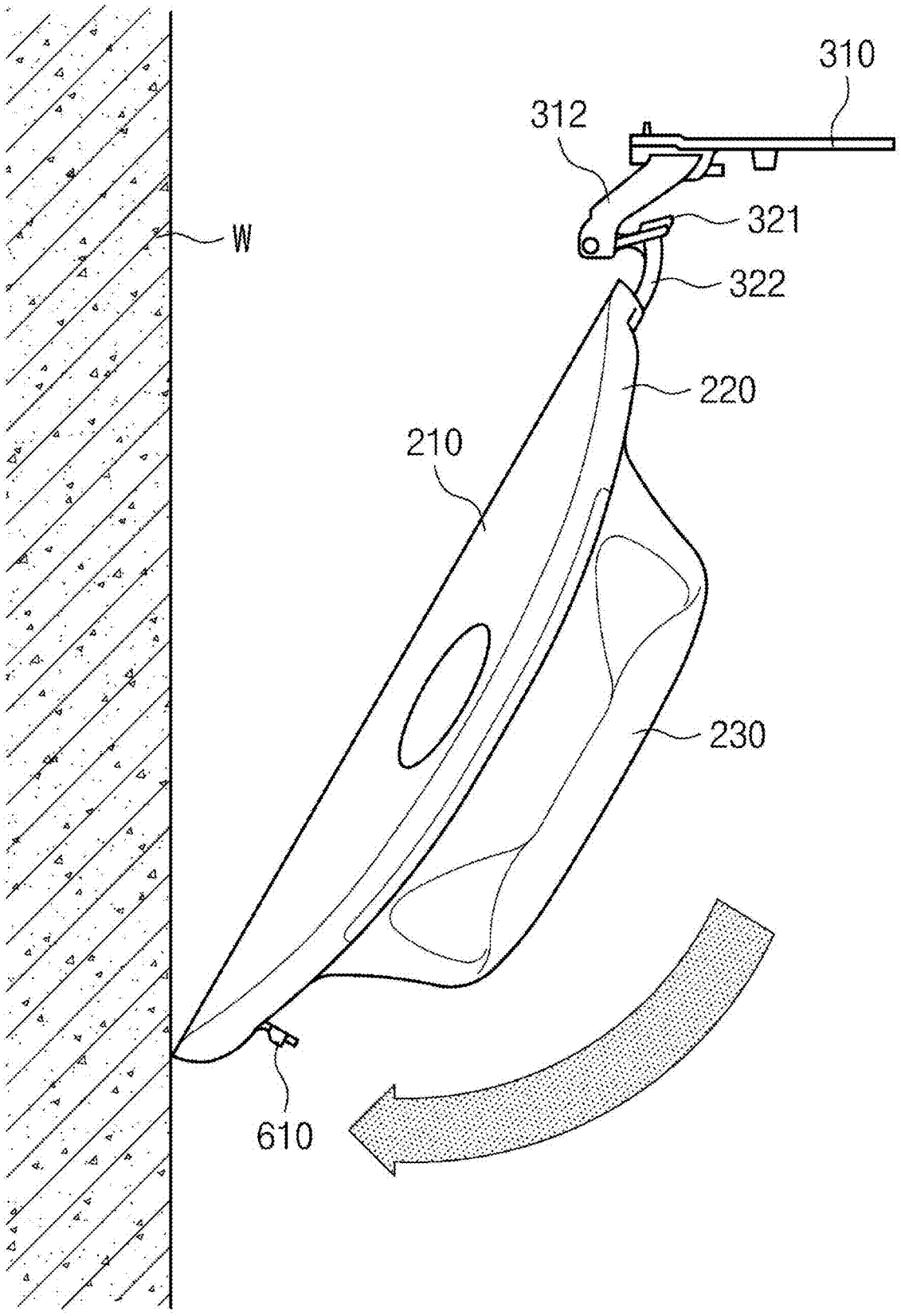

【FIG 13】
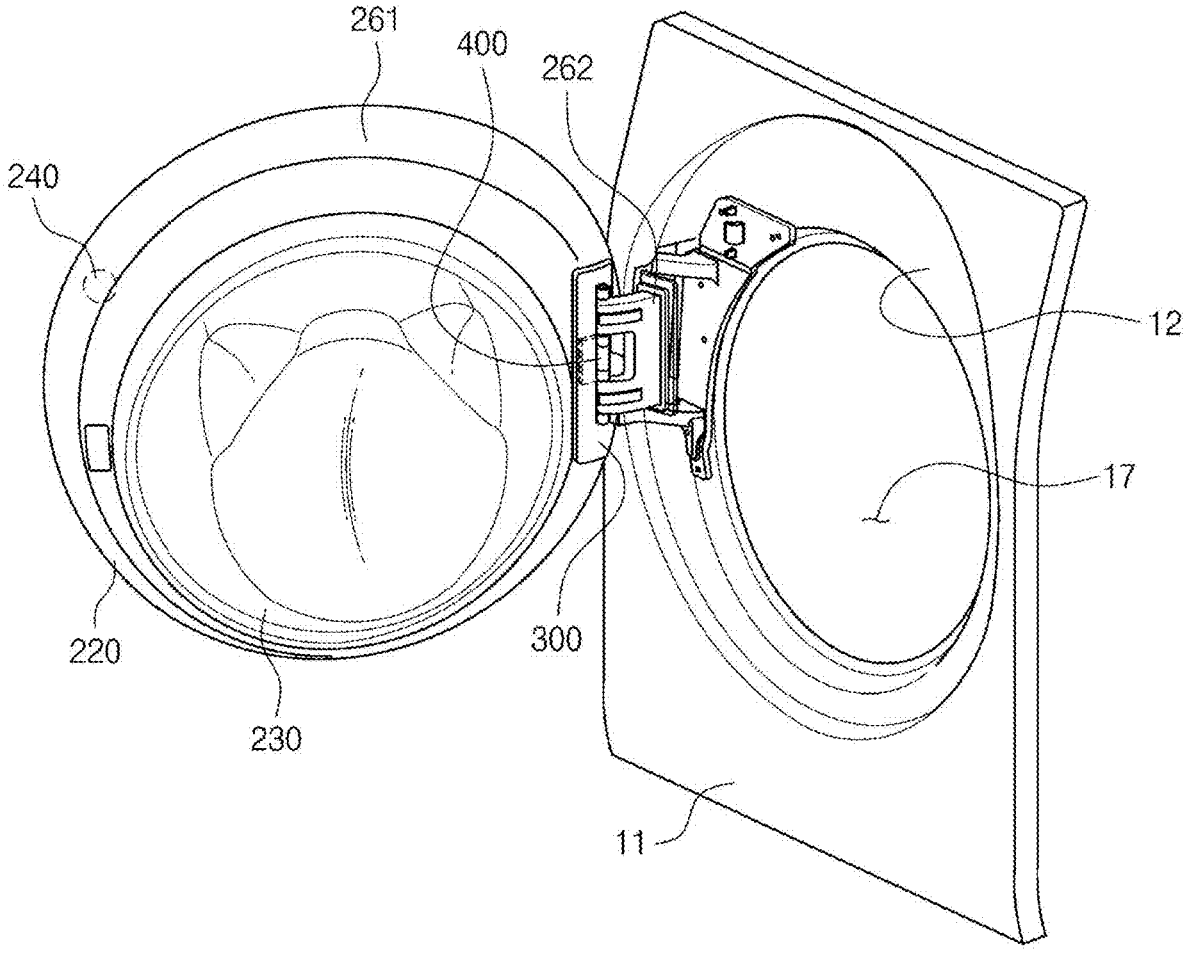

【FIG 14】
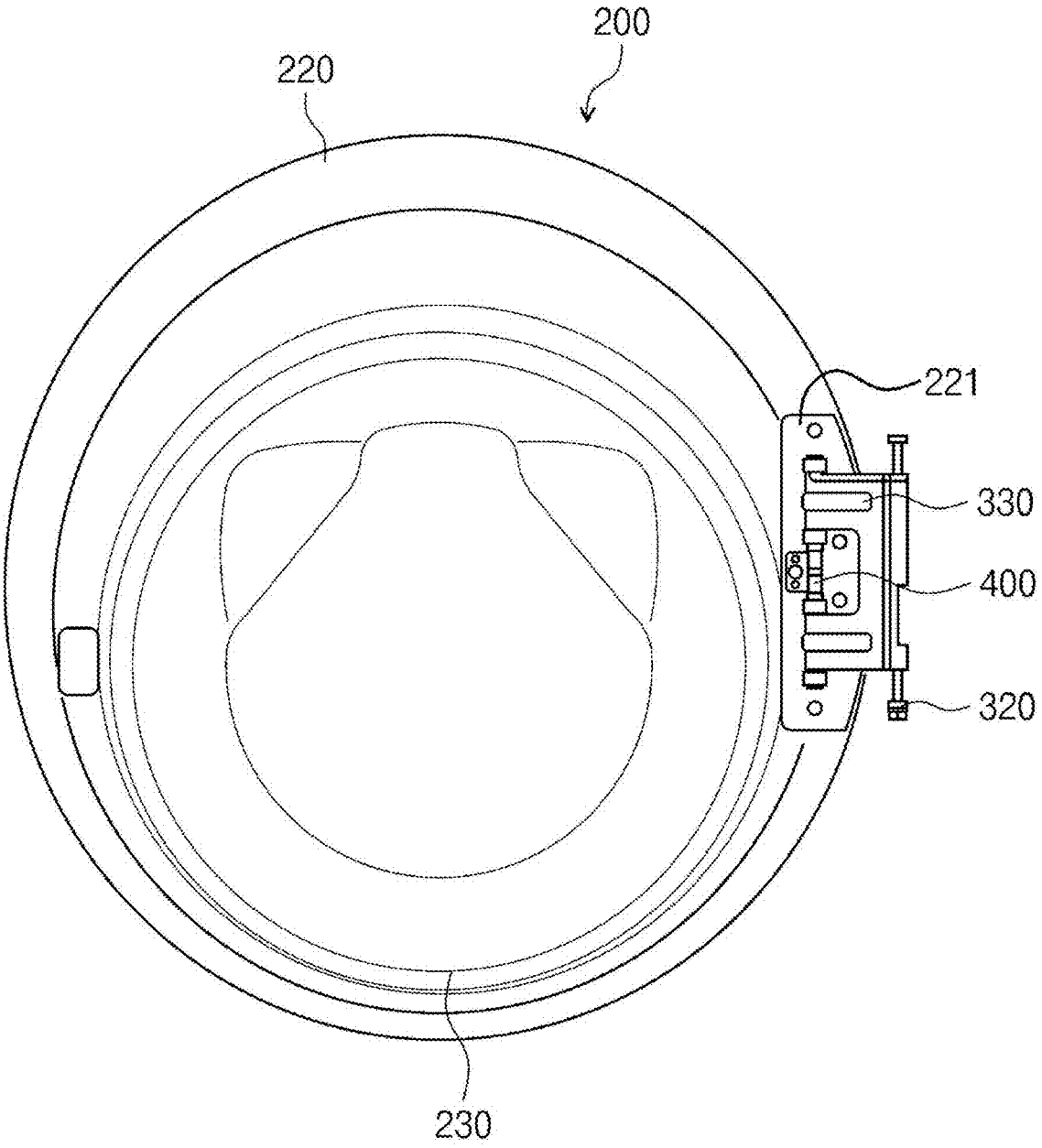

【FIG 15】
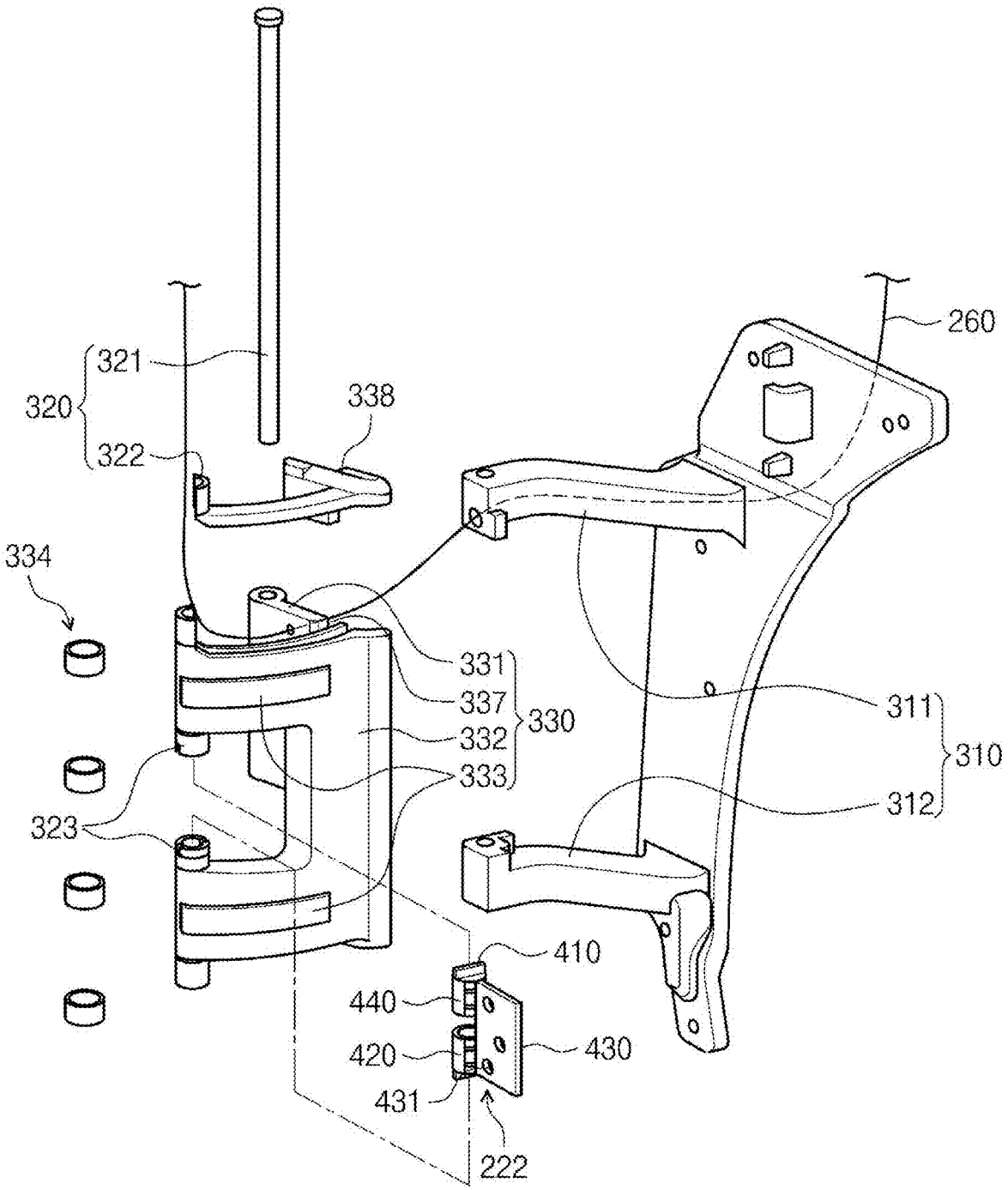

【FIG 16】
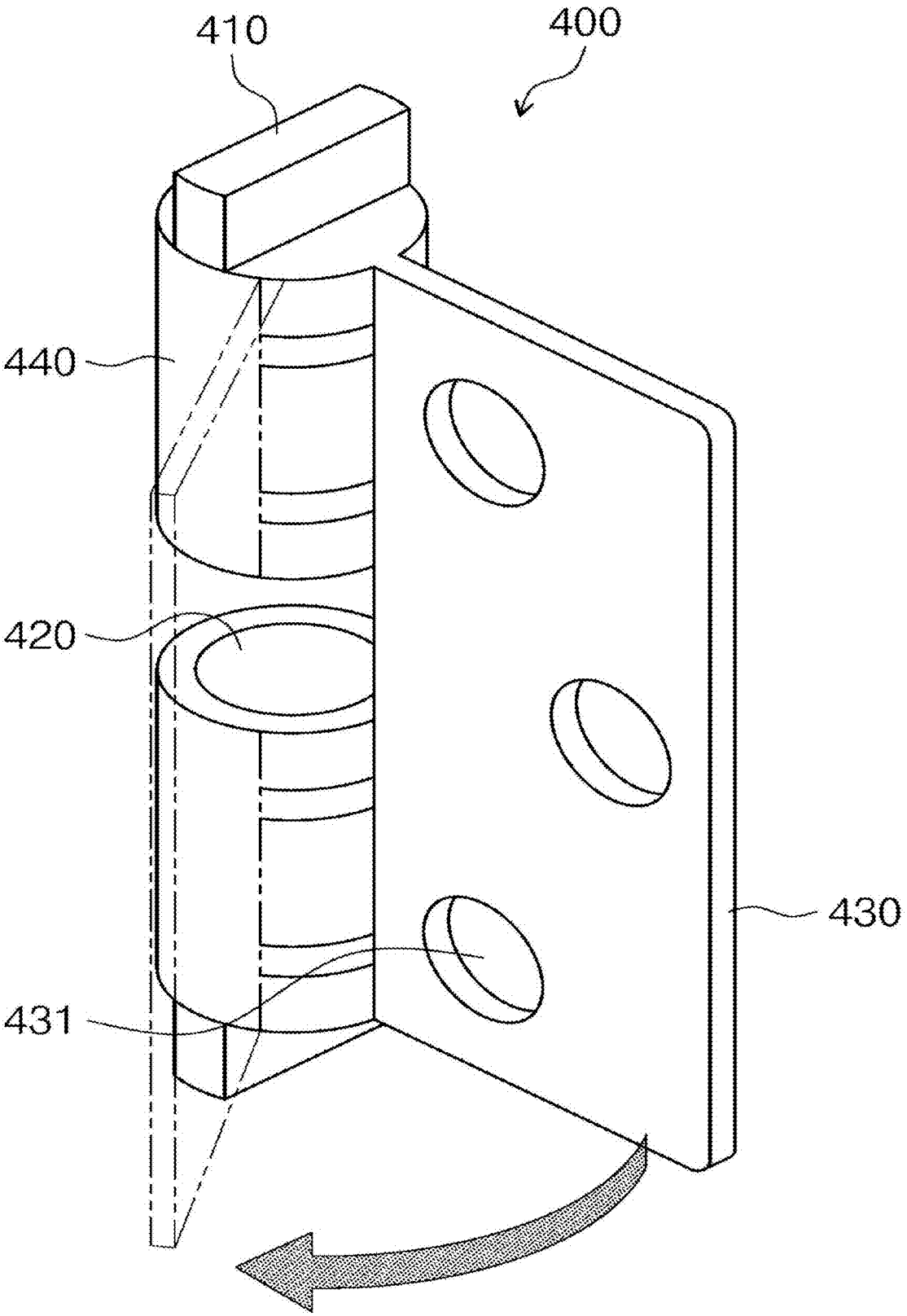

【FIG 17】
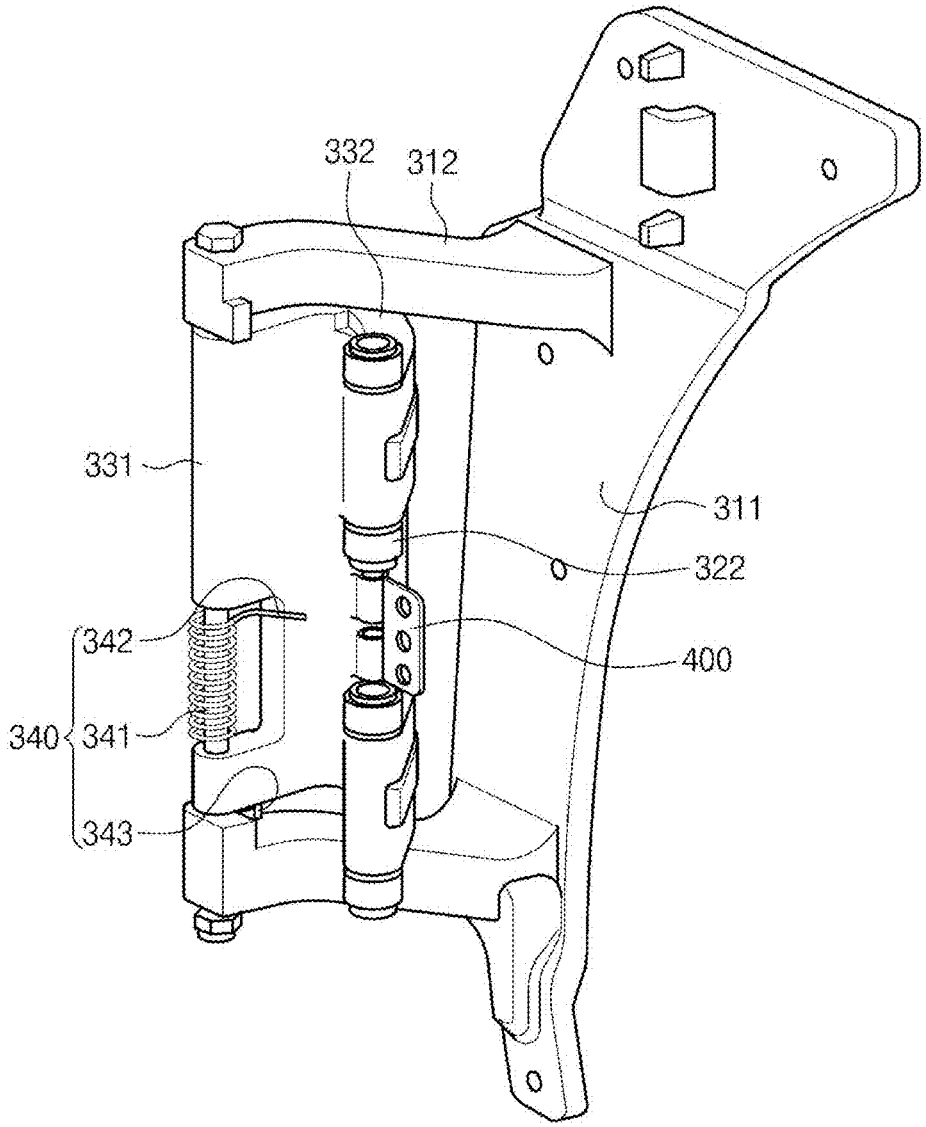

【FIG 18】
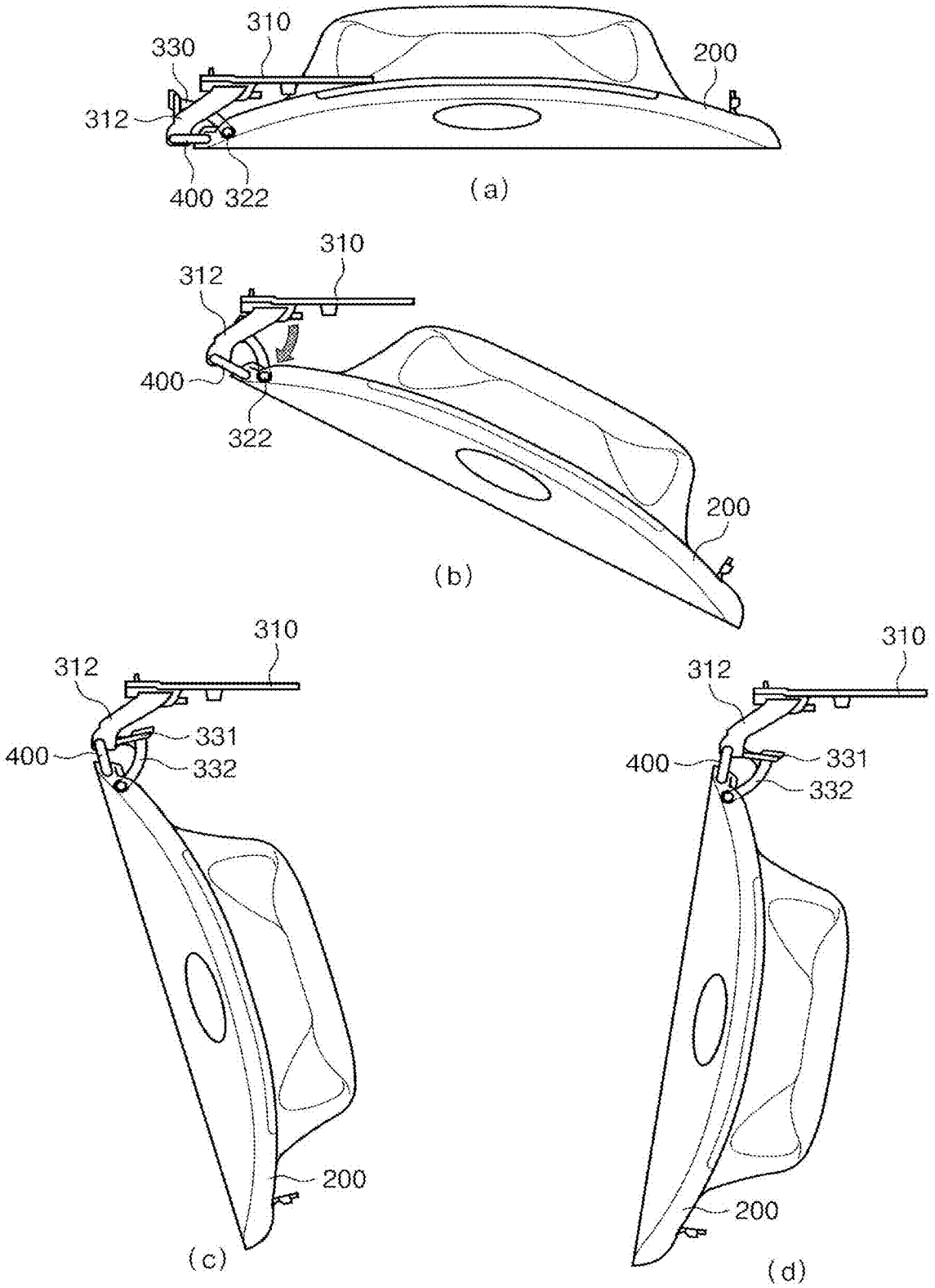

LAUNDRY TREATING APPARATUS

This application claims the benefit of Korean Patent Application No. 10-2023-0115799, filed on Aug. 31, 2023, which is hereby incorporated by reference as if fully set forth herein.

BACKGROUND

Field

The present disclosure relates to a laundry treating apparatus.

Discussion of the Related Art

In general, a laundry treating apparatus is constructed to perform at least one of a washing course of removing foreign substances from laundry and a drying course of removing moisture from the laundry.

In particular, the laundry treating apparatus that performs the drying course is of a front-load type in which a inlet is defined at a front side to evenly supply hot air to an entirety of the laundry. Such a laundry treating apparatus is equipped with a door that opens and closes the inlet to prevent the laundry or water from being discharged via the inlet, but there is a problem that the door may be opened arbitrarily because of a high water pressure or the like when a large amount of laundry is contained or a drum rotates quickly.

To prevent such problem, an existing laundry treating apparatus was equipped with a lock that selectively locks the door to a cabinet having the inlet to prevent the door from being opened arbitrarily.

However, because the lock is detachably coupled to the door even when the door is unlocked, the door was not able to easily open the inlet because of the lock. Accordingly, a user of the existing laundry treating apparatus was able to open the inlet only by applying a strong external force, such as pulling the door from the inlet.

Such existing laundry treating apparatus had a problem in that the user is not able to easily open the door when the user is not able to grip the door such as when holding the laundry or the like in both hands. Therefore, the user had to put the item down somewhere else, then grip and open the door, and then pick up the item again, which was inconvenient.

In particular, in the case of such front-load type washer, because the inlet is located lower than a user's waist, the user's waist or knees were strained when putting down or picking up the item or pulling the door.

Recently, a laundry treating apparatus in which a front surface of the door is not exposed to plastic and is made entirely of a transparent material has appeared (see Korean Patent Application Publication No. 10-2018-0090005).

When the door was built to be gripped by the user, fingerprints were left on the front surface of the door or the front surface of the door was contaminated, which reduced an aesthetic appeal.

SUMMARY

The present disclosure is to provide a laundry treating apparatus whose door may be opened without pulling the door out of a inlet.

The present disclosure is to provide a laundry treating apparatus whose door may be opened even when only a portion of user's body comes into contact therewith, without the user needing to grab the door with hand.

The present disclosure is to provide a laundry treating apparatus whose door may open a inlet even when a user simply presses the door.

The present disclosure is to provide a laundry treating apparatus having two or more schemes of opening a door.

The present disclosure relates to a laundry treating apparatus including a lock disposed on a cabinet to selectively lock a door to the cabinet, and a sensor disposed in the door to receive an opening command for the door to open a inlet.

The lock may be controlled to unlock the door when the sensor receives the opening command.

The lock may repeat a process of sequentially locking and unlocking the door whenever the door is pressed toward the inlet.

The sensor may be equipped as a touch panel.

The lock may be disposed on an opposite side of the inlet from the hinge.

The sensor may be disposed on a surface of the door and may be disposed upward of the hinge and the lock.

The sensor may be disposed closer to the lock than to the hinge.

The sensor may be disposed in an area spaced upwardly apart from the hinge with an angle equal to or greater than 90 degrees based on a center of the door, and the sensor may be disposed in an area spaced upwardly apart from the lock with an angle smaller than 90 degrees.

The sensor may be disposed closer to an outer circumferential surface of the door than to a center of the door.

The laundry treating apparatus may further include a first cable connecting the sensor with the control panel, and the first cable may connect the sensor with the control panel via the hinge.

The laundry treating apparatus may further include a second cable connecting the control panel with the lock.

The hinge may include a mounting portion coupled to the cabinet and supporting the door, a connector having one side rotatably coupled to the mounting portion and an opposite side coupled to the door to guide the rotating of the door, and a stopper having one side coupled to the connector and an opposite side coupled to the door to restrict a rotating angle of the door.

The laundry treating apparatus may further include an elastic body coupled to the connector and the mounting portion to adjust a rotating angle of the connector and restrict the rotating angle of the door.

At least one of the mounting portion and the connector may include a guide groove where the first cable is accommodated and installed.

The laundry treating apparatus may further include a driver that rotates the drum, and the sensor may be controlled to be deactivated from receiving the opening command when the driver operates.

The sensor may be controlled to be deactivated from receiving the opening command when the water supply valve is opened.

The laundry treating apparatus may further include an executor that is disposed upward of the inlet and receives an execution command to execute a course for treating the laundry, and when the executor is pressed, the lock may maintain the door in a locked state even when the sensor receives the opening command.

The present disclosure has the effect of opening the door without pulling the door out of the inlet.

The present disclosure has the effect of opening the door even when only the portion of user's body comes into contact therewith, without the user needing to grab the door with hand.

The present disclosure has the effect that the door opens the inlet even when the user simply presses the door.

The present disclosure has the two or more schemes of opening the door, so that even when one scheme is not available, the door may be opened using another scheme.

BRIEF DESCRIPTION OF THE DRAWINGS

FIG. 1 shows an outer appearance of a laundry treating apparatus of the present disclosure.

FIG. 2 shows an embodiment of an internal structure of a laundry treating apparatus of the present disclosure when including a composite apparatus.

FIG. 3 shows a structural embodiment of the control panel 100 of a laundry treating apparatus of the present disclosure.

FIG. 4 shows an outer appearance of a mini-apparatus that may be included in a laundry treating apparatus of the present disclosure.

FIG. 5 shows an embodiment of an internal structure of a laundry treating apparatus of the present disclosure when equipped as a mini-apparatus.

FIG. 6 shows an embodiment of a door opening/closing structure of a laundry treating apparatus of the present disclosure.

FIG. 7 shows a connection relationship between a sensor and a lock.

FIG. 8 shows an arrangement of the cable.

FIG. 9 shows a specific structural embodiment of the hinge 300.

FIG. 10 shows an additional embodiment of a laundry treating apparatus of the present disclosure in which a door is opened.

FIG. 11 shows a structural embodiment of a lock.

FIG. 12 shows that an opening angle of the door needs to be restricted.

FIG. 13 shows an embodiment of restricting a rotating angle of the door.

FIG. 14 shows a location where the stopper is installed.

FIG. 15 shows a structure in which the stopper and the hinge are coupled to the door.

FIG. 16 shows an operation scheme of the stopper.

FIG. 17 shows an embodiment of reducing a rotating speed of the door.

FIG. 18 shows a method in which a door pivots outward of a side surface of the cabinet 10.

DESCRIPTION OF SPECIFIC EMBODIMENTS

Hereinafter, embodiments disclosed herein will be described in detail with reference to the attached drawings. In the present document, identical or similar components are assigned identical or similar reference numerals even in different embodiments, and descriptions thereof are replaced with the first description. A singular expression used herein includes a plural expression unless the context clearly indicates otherwise. In addition, when describing the embodiments disclosed herein, when it is determined that a detailed description of a related known technology may obscure the gist of the embodiments disclosed herein, the detailed description thereof will be omitted. In addition, it should be noted that the attached drawings are only intended to facilitate easy understanding of the embodiments disclosed herein, and the technical ideas disclosed herein should not be construed as being limited by the attached drawings.

FIG. 1 shows an outer appearance of a laundry treating apparatus of the present disclosure.

The laundry treating apparatus of the present disclosure may be constructed as either a washer 1 or a dryer 2, or may include a composite apparatus 4 in which the washer 1 and the dryer 2 are integrated.

A following description will be made based on the laundry treating apparatus of the present disclosure being constructed as the composite apparatus 4, but this is only for description, and does not exclude a possibility of the laundry treating apparatus of the present disclosure being constructed as the washer 1, the dryer 2, or a combination of the washer 1 and the dryer 2 arranged vertically.

The composite apparatus 4 of the present disclosure may include a cabinet 10 forming an appearance thereof. A inlet through which laundry may be inserted and withdrawn may be defined in a front surface of the cabinet 10, and the inlet may be opened and closed by a door 200.

The door 200 may be rotatably coupled to the cabinet 10 and selectively open and close the inlet. The door 200 may be formed such that only a transparent material of the front surface is exposed when fixed or locked to the cabinet 10. To this end, the front surface of the door 200 may be made of glass or a transparent material such as plastic or acrylic.

A control panel 100 that controls the laundry treating apparatus of the present disclosure may be disposed above the door 200. The control panel 100 may be installed on a front panel of the cabinet.

The control panel 100 may receive various commands from the user. The control panel 100 may display information on the laundry treating apparatus to the outside. To this end, at least a portion of the control panel 100 may be constructed as a touch panel.

The control panel 100 may have a width greater than a height, and may be formed in a shape such as an oval or a track on a sports field. Therefore, the control panel 100 may display more information than when it is formed in a circular shape, or may easily display completed sentences, phrases, and the like.

The laundry treating apparatus of the present disclosure may further include the control panel 100 that receives a command to perform the course, displays a state of performing the course, and displays information or the like necessary for performing the course.

The T control panel 100 may include at least one of a plurality of buttons or the touch panel for receiving the command from the user, a microphone for receiving a user's voice, a camera or a proximity sensor for receiving an operation or a state of the user, a screen for displaying visual information to the user, and a speaker for transmitting auditory information to the user.

When the laundry treating apparatus of the present disclosure is of a front-load type in which the inlet is defined at a front side of the cabinet, the control panel 100 may be disposed above the door 200 on the front surface of the cabinet 10. Thus, accessibility and identifiability may be secured.

In one example, when the laundry treating apparatus of the present disclosure is of a top-load type in which the inlet is defined in a top surface of the cabinet, the control panel 100 may be disposed in front of the door 200 on the top surface of the cabinet 10.

The laundry treating apparatus of the present disclosure may perform functions of both the washer 1 and the dryer 2, and may be additionally equipped with a drawer-type laundry treating apparatus (hereinafter, a mini-apparatus) at a lower portion thereof. In this case, the control panel 100 may be formed as a composite panel that may control at least one of the washer 1, the dryer 2, and a lower mini-apparatus 5 of the composite apparatus 4 at once.

When the laundry treating apparatus of the present disclosure is constructed as the composite apparatus 4, a filter 14 may be detachably disposed in an upper portion of the cabinet 10.

The filter 14 is constructed to filter foreign substances in a circulating duct that is accommodated inside the cabinet 10 and circulates air, and the circulation duct is able to be disposed closer to the upper portion of the cabinet 10 than to a lower portion of the cabinet 10.

The door 200 may be coupled with the cabinet 10 in a push button form.

Accordingly, even in a situation in which the user is not able to pull the door 200, such as when the user is holding the laundry in both hands, the door 200 may be sequentially fixed to the cabinet 10 or separated from the cabinet 10 when being pressed to ward the inlet or the cabinet 10.

Because the door 200 is rotatably coupled to a hinge, which will be described later, on one side of the inlet, it is preferable that a portion where the door 200 is coupled to the cabinet 10 is installed in an area facing the hinge with respect to the inlet.

In addition, the door 200 may have a pressing portion 250 disposed in an area opposite the hinge with respect to the inlet. Specific details of the pressing portion 250 will be described later.

The door 200 may further include a sensor 240 that receives a user's pressure or touch and separates the door 200 from the cabinet 10.

The sensor 240 may be equipped as a component that may sense a user's physical contact. For example, the sensor 240 may include any component that may sense the user's physical contact, such as a touch film, a touch panel, a physical button, or a piezoelectric element installed on the door 200.

The door 200 may be opened from the cabinet 10 even when it is not pressed toward the cabinet 10 when the user touches or presses the sensor 240. As a result, an occurrence of damage or scratches when the door 200 is pressed by the user, an item, or the like may be prevented in advance.

The sensor 240 may be disposed near the pressing portion 250. As a result, the user may intuitively recognize that the sensor 240 and the pressing portion 250 are areas that are pressed by the user.

The sensor 240 may be built into the door 200, but may be visible on an outer surface of the door 200. Accordingly, the sensor 240 may further include a separate light emitting body. In one example, an area where the sensor 240 is installed on the surface of the door 200 may be indicated via marking, shading, and the like.

The laundry treating apparatus of the present disclosure may additionally include the mini-apparatus 5 disposed beneath the composite apparatus 4. The mini-apparatus 5 may be disposed beneath the composite apparatus 4, and the composite apparatus 4 may be seated and disposed on the mini-apparatus 5.

An installation vertical level of the composite apparatus 4 may be increased because of the mini-apparatus 5. Therefore, when the laundry treating apparatus is of the front-load type in which the door 200 of the composite apparatus 4 is disposed on the front surface of the cabinet 10, the user may easily access the door 200 with little to no bending of waist.

Detailed configurations of the composite apparatus and the mini-apparatus will be described later.

FIG. 2 shows an embodiment of an internal structure of a laundry treating apparatus of the present disclosure when including a composite apparatus.

The laundry treating apparatus of the present disclosure may include a tub 20 accommodated inside the cabinet 10 to store water therein, and a drum 30 rotatably accommodated in the tub 20 to store water therein.

The laundry treating apparatus of the present disclosure may include a water supply 50 that supplies water to the tub 20, and a drainage 60 that drains water from the tub 20.

The water supply 50 may include a water supply valve 51 that is coupled to the cabinet 10 and connected to an external water source to selectively supply water, a water supply pipe 52 that extends from the water supply valve 51 and delivers water supplied from the external water source, and a detergent box 53 that stores detergent therein, receives water supplied from the water supply pipe 52, and delivers water to the tub 20.

The drainage 60 may include a discharge pipe 61 connected to a lower portion of the tub 20 to discharge water from the tub 20, a drainage pump 62 that provides power to discharge water supplied from the discharge pipe 61 to the outside of the cabinet 10, and a drainage pipe 63 that extends from the drainage pump 62 to the outside of the cabinet 10 to discharge water.

The laundry treating apparatus of the present disclosure may further include a water level sensor 21 that senses a water level of the tub 20.

The water level sensor 21 may be equipped as any component as long as it is able to sense the water level inside the tub 20. The water level sensor 21 may include a communication pipe that is in communication with the tub 20 and has a blocked distal end, and a device that is disposed on the communication pipe to sense a pressure change inside the communication pipe.

The laundry treating apparatus of the present disclosure may further include a support 70 that supports the tub 20 in the cabinet 10.

The support 70 may include at least one of a suspension that supports the lower portion of the tub 20 and a spring that supports an upper portion of the tub 20.

The laundry treating apparatus of the present disclosure may include a driver 40 having the same structure as that of the general washer 1.

In addition, the laundry treating apparatus of the present disclosure may further include the heat supply 90 that circulates air inside the tub 20 and is able to heat the air. The heat supply 90 may be disposed downward of the tub 20.

However, because the tub 20 is a component that is closest to the drum 30 and the lower portion of the tub 20 has the drainage 60, the heat supply 90 may be seated and disposed on the tub 20.

The heat supply 90 may be seated and disposed on the tub 20. That is, the heat supply 90 may be positioned upward of the inlet of the tub.

The heat supply 90 may include at least one of a circulating duct 91 extending in a front and rear direction of the tub 20 to circulate air inside the tub 20, an evaporator 92 accommodated in the circulating duct 91 to cool air and condense moisture, a condenser 93 disposed downstream of the evaporator to heat air, a compressor 94 that supplies a refrigerant that heats air to the condenser 93, an expansion valve that expands and cools the refrigerant discharged from the condenser 93 and delivers the refrigerant to the evaporator 92, and a circulating fan 96 disposed inside the circulating duct 91 to provide power to circulate air.

In one example, because the tub 20 is disposed, the heat supply 90 may omit a water collector and a water storage tank that collect condensate therein. That is, water condensed inside the circulating duct 91 may be collected into the tub 20 and discharged into the drainage 60.

The laundry treating apparatus of the present disclosure may perform a plurality of courses for treating the laundry based on the above configuration. The courses may include a washing course of removing foreign substances from the laundry and a drying course of removing moisture from the laundry.

The laundry treating apparatus of the present disclosure may include an integrated controller in which a controller that performs the washing course and a controller that performs the drying course are integrated, and the integrated controller may be built into the control panel 100 or may be installed inside the cabinet 10 separately from the control panel 100.

FIG. 3 shows a structural embodiment of the control panel 100 of a laundry treating apparatus of the present disclosure.

The control panel 100 may be switched to either of a washing mode of receiving a command to perform the washing course or displaying a state of the washing course or a drying mode of receiving a command to perform the drying course or displaying a state of the drying course.

In addition, when there is the mini-apparatus, which will be below, the control panel 100 may receive a command to operate the mini-apparatus or be switched to a mini-mode of displaying a state of the mini-apparatus.

The control panel 100 should implement all of the washing mode of performing the washing course, the drying mode of performing the drying course, and the mini-mode of operating the mini-apparatus.

Therefore, it is preferable that the control panel 100 is entirely constructed as the touch panel, omitting physical buttons or the like, and the washing mode, the drying mode, and the mini-mode are selectively displayed. As a result, the plurality of buttons and indicators for respectively performing the washing mode, the drying mode, and the mini-mode may be omitted.

The control panel 100 may include a display 150 in a central square portion.

A power unit 110 that receives a power command to supply power and an executor 120 that receives an execution command to execute a selected course may be disposed on respective sides of the display 150.

The power unit 110 and the executor 120 may be equipped as touch areas that may receive a touch input, and may illuminate when the touch input is available and turn off when the touch input is not available.

The display 150 may display weight information related to a sensed weight of the laundry and state information regarding the selected course and an option.

Furthermore, the display 150 may be constructed as a touch panel and may also perform roles of a course input unit 130 that receives a course selection command to select one of the courses provided by the laundry treating apparatus, and an option selection unit 140 that receives an option selection command to add additional conditions and functions to the course.

For example, the course input unit 130 that may select the course may be displayed on the display 150. For example, a selected course C1 may be displayed in large letters, and alternative courses C2 and C3 may be displayed in small letters on left and right sides. As a result, the display 150 may perform the function of the course input unit 130.

The display 150 may further include a state display 153 that displays a state of the laundry treating apparatus. The state display 153 may display at least one of an internal water level state, an internal temperature state, a lock state, a sound transmission state, and a course progress state in a form of icons or the like.

The option selection unit 140 may be disposed outward of the course input unit 130 or of an area where the course is displayed. The option selection unit 140 may be disposed to be spaced downwardly apart from the state display 153.

When the option selection unit 140 is pressed, the display 150 may display options that may be selected or adjusted. During this process, the course input unit 130 and the display of the course C may disappear.

FIG. 4 shows an outer appearance of a mini-apparatus that may be included in a laundry treating apparatus of the present disclosure.

The mini-apparatus 5 may have a height and a volume smaller than those of the composite apparatus 4.

The mini-apparatus, as an auxiliary laundry treating apparatus, may be additionally installed to the composite apparatus 4. In one example, the mini-apparatus 5 may be constructed independently.

When the laundry treating apparatus of the present disclosure is constructed as the mini-apparatus 5, the cabinet 10 may include a mini-cabinet 10*b* whose height is smaller than a width in a left and right direction and a length in a front and rear direction.

The mini-cabinet 10*b* has the small height, so that the mini-cabinet 10*b* may be disposed beneath the composite apparatus 4.

In one example, the mini-apparatus 5 may be disposed on top of the composite apparatus 4, but for convenience of description, a description will be made based on the assumption that the mini-apparatus 5 is disposed beneath the composite apparatus 4 or is disposed independently.

The mini-cabinet 10*b* may have a inlet defined in a front surface thereof.

The mini-apparatus 5 may further include a drawer 80 that may be extended and retracted via the inlet in the mini-cabinet 10*b*.

The drawer 80 may include a drawer body 82 that accommodates therein a tub that accommodates water inside or a rotating drum, a drawer panel 81 that is disposed in front of the drawer body 82 to open and close the inlet, and a rail 83 that allows the drawer body 82 to be extended from and retracted into the mini-cabinet 10*b*.

The drawer body 82 may be formed in a casing shape with an open top, and may further include a mini-door 29 that opens or closes the tub and drum inside.

The mini-apparatus 5 may include the drawer 80, so that interference with use thereof may be prevented even when there is another laundry treating apparatus or home appliance located thereon.

The mini-apparatus 5 may also include an independent control panel on the drawer 80.

FIG. 5 shows an embodiment of an internal structure of a laundry treating apparatus of the present disclosure when equipped as a mini-apparatus.

The mini-apparatus 5 may include a mini-tub 20*b* that accommodates water inside the drawer 80, and a mini-drum 30*b* that is rotatably disposed in the mini-tub to accommodate laundry therein.

Each of the mini-tub 20*b* and the mini-drum 30*b* may have a height smaller than a diameter, and an inlet through which the laundry is input may be defined in a top surface thereof.

The mini-door 29 may be coupled to the top surface of the mini-tub 20*b* to prevent water or the laundry inside the mini-tub 20*b* from being randomly discharged.

The driver 40 may be disposed under the mini-tub 20*b* to rotate the mini-drum 30*b*.

The driver 40 may include a mini-stator 41*b* coupled to a lower portion of the mini tub 20*b* to generate a rotating magnetic field, a mini-rotor 42*b* rotated by the mini-stator 41*b*, and a mini-rotation shaft 43*b* that is rotated by the mini-rotor and coupled to a lower portion of the mini-drum 30*b*.

The water supply 50 may include a mini-water supply valve 51*b* coupled to the mini-cabinet 10*b*, a mini-water supply pipe 52*b* that extends from the mini-water supply valve 51*b* to the drawer and supplies water, and a mini-box 53*b* that guides water supplied from the mini-water supply pipe 52*b* to the tub.

The mini-water supply pipe 52*b* may have a structure that extends forward by a length of the drawer 80 that is extended from the mini-cabinet 10*b*. The mini-box 53*b* may be constructed such that detergent is injected thereinto and stored therein.

The drainage 60 may include a mini-discharge pipe 61*b* that discharges water from the mini-tub 20*b*, a mini-pump 62*b* coupled to the mini-discharge pipe 61*b* to provide power for discharging water, and a mini-drainage pipe 63*b* extending from the mini-pump 62*b* to the outside of the mini-cabinet 10*b*.

The mini-drainage pipe 63*b* may have a structure extending forward by the length of the drawer 80 that is extended from the mini-cabinet 10*b*.

The support 70 may include a mini-suspension 70*d* connecting an inner surface of the drawer 80 with an outer surface of the mini-tub 20*b*.

FIG. 6 shows an embodiment of a door opening/closing structure of a laundry treating apparatus of the present disclosure.

(a) in FIG. 6 shows a state in which the door 200 closes the inlet, and (b) in FIG. 6 shows a state in which the door 200 opens the inlet.

The laundry treating apparatus of the present disclosure may further include a lock 600 that selectively fixes or locks the door 200 to the cabinet 10.

The fact that the lock 600 has locked the door 200 means that even when the door 200 is pulled away from the cabinet 10, the door 200 will not open the inlet.

The fact that the lock 600 has unlocked the door 200 means that when the door 200 is pulled away from the cabinet 10, the door 200 will open the inlet. Therefore, even when the lock 600 has unlocked the door 200 with respect to the cabinet 10, the door 200 may maintain the inlet closed.

The cabinet 10 has the inlet that extends through a front panel 11 in a circular shape, and has a seating surface 12 on which the door 200 may be seated in an outer circumferential surface of the inlet.

The seating surface 12 may be formed in a ring shape and define the inlet in an inner circumferential surface thereof.

The seating surface 12 may be recessed inward from the front panel 11 and have the inner circumferential surface identical to an outer circumferential surface of the door 200. Thus, when the door 200 closes the inlet, the door 200 may be at least partially accommodated on the seating surface 12.

The lock 600 may include a fastener 610 disposed on the door 200 and a coupler 650 disposed on the cabinet 10 and detachably coupled to the fastener 610. The coupler 650 may be disposed on an inner side of the seating surface 12.

The fastener 610 may be constructed as one of a protruding hook and a fixer fastened to the hook, and the coupler 650 may be constructed as the other of the hook and the fixer.

FIG. 6 shows an embodiment in which the fastener 610 is constructed as the hook disposed on the door 200 and the coupler 650 is constructed as the fixer coupled to the hook, but the fastener 610 of the door 200 may be constructed as the fixer and the coupler 650 may be constructed as the hook protruding from the cabinet.

When the coupler 650 is disposed on the seating surface 12, the seating surface 12 may include a through-hole 15 such that the coupler 650 is exposed to the outside.

In the present embodiment, the fixer is exposed via the through-hole 15, but in another embodiment, the hook may protrude via the through-hole 15.

The door 200 includes an outer surface 210 having an area size corresponding to an area size of the seating surface 12, a door frame 220 coupled to the outer surface 210 and supporting the outer surface 210, and an inner surface 230 coupled to the door frame 220.

The outer surface 210 may be formed in a transparent disc shape, the door frame 220 may be formed in a ring shape such that the inlet is exposed to the outside, and the inner surface 230 may be made of a transparent material such that the inside of the drum is exposed to the outside of the door 200. At least a portion of the inner surface 230 may protrude to be inserted into the inlet and may perform a role of pushing the laundry approaching the inlet into the drum.

The laundry treating apparatus of the present disclosure may further include a hinge 300 that rotatably couples the door 200 to the cabinet 10.

The hinge 300 may be disposed on at least one of both sides of the inlet. That is, the hinge 300 may be disposed at one of both sides of the seating surface 12.

When the hinge 300 is disposed at one side of the seating surface 12, it is preferable that the lock 600 corresponds to the other side of the seating surface 12.

Therefore, the lock 600 may fix an area having the greatest rotating momentum and movement distance of the door 200, so that the door 200 may be prevented from being spaced apart from the seating surface 12.

In one example, the door 200 may be equipped with the sensor 240 described above. When the sensor 240 is touched, the lock 600 may unlock the door 200 even when it is not pressurized.

That is, when the sensor 240 is pressed, the control panel 100 or the controller of the laundry treating apparatus of the present disclosure may be controlled such that the lock 600 unlocks the door 200.

For example, the sensor 240 may release the coupling of the coupler 650 and the fastener 610.

To this end, the lock 600 may further include an actuator that allows the fastener 610 to release the coupling with the coupler 650.

The actuator may operate in any manner as long as it allows the fastener 610 to release the coupler 650 when a signal is input.

For example, the actuator may provide a physical force to at least one of the coupler 650 and the fastener 610, so that the fastener 610 may release the coupling with the coupler 650. An embodiment of the actuator will be described later.

The sensor 240 may be disposed upward of the lock 600. As a result, the user may easily extend a hand thereof and manipulate the sensor 240.

The sensor 240 may be disposed upward of the pressing portion 250 on the door 200.

The sensor 240 may be disposed between the outer surface 210 and the door frame 220 of the door. The sensor 240 may be disposed on an inner wall of the outer surface 210 of the door so as to sense static electricity, current, and the like flowing through a user's body.

For example, the sensor 240 may include a touch film or a touch panel that receives an opening command to open the door via the contact of the user's body or the pressurization, and a PCB panel that receives the opening command and converts the command into an electric signal. The touch film or the touch panel may be disposed so as to be identifiable on a surface of the door. For example, the touch film or the touch panel may be attached to the inner wall of the outer surface 210 of the door, and the PCB panel may be seated on and fixed to the door frame 220.

The sensor 240 may be disposed closer to the pressing portion 250 and the lock 600 than to the hinge 300. Accordingly, it may be naturally shown that the sensor 240 has a function of opening the door 200.

The sensor 240 may be disposed close to the control panel 100. Accordingly, the user may easily control the control panel 100 and the sensor 240.

The sensor 240 may be disposed in an area that is located upward of a center of the door 200 and the lock 600 or the pressing portion 250 with an angle range of 0 degrees to 90 degrees. The sensor 240 may not be disposed in an area with the angle of 90 degrees, that is, an upper end of the door 200. Accordingly, this prevents the sensor 240 from being incorrectly pressed while manipulating the control panel 100.

For example, the sensor 240 may be disposed at an 1 o'clock or 2 o'clock location based on the center of the door 200.

FIG. 7 shows a connection relationship between a sensor and a lock.

The laundry treating apparatus of the present disclosure may include a cable 260 that receives an input signal of the sensor 240 and transmits an opening signal for the lock 600 to open the door 200.

The cable 260 may directly or indirectly connect the sensor 240 and the lock 600 to each other. Accordingly, even when the sensor 240 is disposed in the door and the lock 600 is disposed on the cabinet 10, the lock 600 may operate based on the pressurization of the sensor 240.

The cable 260 may extend from the sensor 240 into the cabinet 10 via the hinge 300 and be connected to the lock 600. In this case, the lock 600 may directly receive the input signal of the sensor 240 and unlock the door 200.

In addition, the cable 260 may include a transmitting line 261 and 262 extending from the sensor 240 to the control panel 100 or the controller via the hinge 300, and an input line 263 connecting the control panel 100 or the controller with the lock 600.

In this case, the input signal of the sensor 240 may be sensed by the control panel 100, and the control panel 100 may transmit the opening signal to the lock 600. Accordingly, power supplied to the control panel 100 or the controller may be supplied to the sensor 240 and the lock 600, and the control panel 100 or the controller may control the sensor 240 and the lock 600.

The transmitting line 261 and 262 may include a first wire 261 extending from the sensor 240 to the hinge 300 along the door frame 220, and a second wire extending from the first wire 261 or connected to the first wire 261 and extending from the hinge 300 to the control panel 100.

The input line 263 may include a third wire extending from the control panel 100 to the lock 600.

FIG. 8 shows an arrangement of the cable.

The sensor 240 is disposed closer to an upper portion than to a lower portion of the door 200.

Accordingly, the first wire 261 may extend from the sensor 240 to the hinge 300 along the upper portion of the door frame 220.

The hinge 300 may accommodate therein and guide the cable 260. The hinge 300 may include a groove that accommodates the cable 260 therein and does not expose the cable 260 to the outside at an upper portion thereof.

The second wire 262 may be guided along the groove of the hinge 300 and may extend into the cabinet 10 by passing through the seating surface 12.

With the configuration of at least one of the cable 260 and the control panel 100, when the sensor 240 is pressed, the lock 600 may consequentially unlock the door.

FIG. 9 shows a specific structural embodiment of the hinge 300.

The hinge 300 may include a mounting portion 310 that is coupled to the cabinet and supports the door 200, a connector 330 that has one side rotatably coupled to the mounting portion 310 and the other side coupled to the door 200 to guide the rotating of the door, and a rotating portion 320 that rotatably couples the connector 330 to the mounting portion 310.

The mounting portion 310 may include a mounting body 311 that is coupled to the inner side of the seating surface 12 on one side of the inlet and supports a load of the door 200, and a door support 312 that extends through the seating surface 12 from the mounting body 311 and is exposed to a front surface of the cabinet 10.

The door support 312 may be formed in a shape of a rib or a bar extending forward from the mounting body 311. The door support 312 may include a plurality of door supports that are spaced apart from each other in a vertical direction of the mounting body 311.

A free end or a distal end of the door support 312 may rotatably support the connector 330.

The connector 330 may include a first member 331 rotatably coupled to the door support 312, and a second member 332 extending from the first member 311 to support the door 200.

The first member 331 may be formed in a shape of a plate, may have one side surface coupled to the rotating portion 320, and may have the other side surface connected to the second member 332.

The second member 332 may extend from the other side surface of the first member 331 while one side surface thereof forms an acute angle with the first member 331.

Third members 333 may extend from upper and lower portions of the other side surface of the second member 332, respectively. The third members 333 may be formed in a rib or rod shape formed as a cut portion is defined in a central portion of the other side surface of the second member 332.

The first member 331, the second member 332, and the third member 333 may be formed integrally, and the second member 332 and the third member 333 may be disposed to form the acute angle with the first member 331.

The door 200 may be rotatably coupled to a free end of the third member 333.

The rotating portion 320 may include a first rotating shaft 321 inserted into a distal end of the door support 312 and one side surface of the first member 331, and a second rotating shaft 322 disposed at the free end of the third member 333 to rotatably couple the door 200.

The second rotating shaft 322 may be formed in a cylindrical shape protruding in a height direction from the free end of each third member 333. This eliminates a need for the separate second rotating shaft 322.

The mounting portion 310, the connector 330, and the rotating portion 320 may be made of a strong metal material.

The connector 330 may further include a bushing 334 that is disposed to surround the second rotating shaft 322 and induces the rotating of the door 200. The bushing 334 may be made of a material with low friction, such as plastic.

As a result, the connector 330 may pivot at the mounting portion 310 and the door 200 may primarily pivot to open and close the inlet, and the door 200 may pivot at the third member 333 to additionally secure an opening angle of the door 200.

The connector 330 may include a guide groove 337 defined in a top surface thereof into which the cable 260 may be inserted and accommodated. The guide groove 337 may be defined as upper ends of the first member 331, the second member 332, and the third member 333 are recessed. The guide groove 337 may have a diameter greater than a diameter of the cable 260. Therefore, the cable 260 may be prevented from being exposed to the outside of the hinge 300 and being short-circuited or exposed to moisture or the like.

The connector 330 may further include a shielding cover 338 that is coupled to the guide groove 337 to prevent the exposure of the cable 260. The shielding cover 338 may be formed to have a shape correspond to a shape of an upper end of the connector 330.

The mounting portion 310 may accommodate therein the cable 260 that has passed through the connector 330 and guide the cable into the cabinet 10. To this end, a groove through which the cable 260 passes may be defined in a bottom surface of the door support 312 disposed at an upper side, and the cable 260 may extend through and pass through a portion of the mounting body 311 where the door support 312 disposed at the upper side extends.

Even when the sensor 240 is disposed in the door 200, the sensor 240 may be electrically connected to at least one of the control panel 100 and the lock 600 equipped inside the cabinet 10 via the cable 260 and the hinge 300 to transmit the input signal.

FIG. 10 shows an additional embodiment of a laundry treating apparatus of the present disclosure in which a door is opened.

(a) in FIG. 10 shows a state in which the door closes the inlet, and (b) in FIG. 10 shows a state in which the door opens the inlet.

The lock 600 may lock the door 200 in a push button form. This means that the lock is constructed to repeat a process of sequentially locking or unlocking the door 200 only when it is pressed by the door 200 and the cabinet 10. Accordingly, even when the door 200 is pressed externally by the laundry or a water pressure inside the cabinet 10, the lock 600 may not open the door 200.

Accordingly, when the pressing portion 250 disposed on the door 200 is pressed, the cabinet 10 and the door 200 may be fixed to each other or separated from each other in a repeated manner.

The pressing portion 250 may be disposed at a location corresponding to the lock 600.

The pressing portion 250 may serve to indicate an area where the lock 600 is disposed. To this end, the pressing portion 250 may include a marking indicating an area outward of the door 200 or may include a separate light-emitter.

The pressing portion 250 may be disposed on a side opposite to that of the hinge 300.

The pressing portion 250 may be disposed at a location that at least partially overlaps the lock 600 when the door 200 closes the inlet.

The pressing portion 250 may be disposed at the same vertical level as the hinge 300.

Referring to (b) in FIG. 10, when the pressing portion 250 is pressurized, even when the door 200 is locked, the lock 600 may unlock the door 200.

Specifically, the fastener 610 may move a certain distance toward the coupler 650, and then release the coupling with the coupler 650 and deviate from the through-hole 15.

The door 200 may be opened by the pressing portion 250 even when the sensor 240 does not function properly.

FIG. 11 shows a structural embodiment of a lock.

The fastener 610 may protrude from the door frame 220 toward the inlet, and the coupler 650 may be disposed on the cabinet 10.

In this case, the fastener 610 may be constructed as the protrusion protruding from the door frame 220 toward the inlet.

The coupler 650 may be composed of a first body 651 fixed to the seating surface 12, and a second body 655 reciprocally disposed within the first body 651 and to which the fastener 610 is detachably coupled.

The first body 651 includes an insertion hole 652 into which the second body 655 is inserted, a spring 653 that provides elasticity to the second body 655, and a guider 654 for controlling a location of the second body 655.

The spring 653 presses the second body 655 toward the insertion hole 652.

As shown in (b) in FIG. 11, the guider 654 may include a first path 654*a* extending from a side where the insertion hole 652 is located toward a rear surface of the first body 651 (in a direction away from the insertion hole), a second path 654*b* extending from one end of the first path toward the insertion hole 652, a third path 654*c* extending from the second path in the direction away from the insertion hole 652, and a fourth path 654*d* extending from the third path 654*c* toward the insertion hole 652 and connected to the other end of the first path 654*a*.

In this case, the second body 655 may be composed of a bar 655*a* rotatably connected to the second body via a shaft 655*b*, a protrusion 655*c* disposed on the bar and inserted into the guider 654, and a first detachable bar 655*d* and a second detachable bar 655*c* rotatably coupled to the second body 655 and exposed to the outside of the first body 651 via the insertion hole 652.

In the lock 600 having the above-described structure, the fastener 610 moves the second body 655 toward the rear surface of the first body 651 when the door 200 closes the inlet.

When the second body 655 is pressurized, the protrusion 655*c* is positioned at a connection point of the second path 654*b* and the third path 654*c* (a first point) along the first path 654*a* and the second path 654*b*, and the first detachable bar 655*d* and the second detachable bar 655*e* pivot toward the fastener 610 while interfering with the insertion hole 652.

As shown in (b) in FIG. 11, when the protrusion 655*c* disposed in the second body is positioned at the first point, the fastener 610 is fixed between the detachable bars 655*d* and 655*e*, so that the door 200 will be locked to the cabinet 10. Therefore, the present disclosure may prevent the drawer from being extended from the cabinet during the rotation of the drum.

In one example, when the user pushes the door 200 once more in the direction toward the inlet in this state, the fastener 610 will pressurize the second body 655. In this case, the protrusion 655*c* moves to a connection point of the fourth path 654*d* and the first path 654*a* (a second point) via the third path 654*c* and the fourth path 654*d*.

As shown in (a) in FIG. 11, when the protrusion 655*c* disposed in the second body is located at the second point, the first detachable bar 655*d* and the second detachable bar 655*e* will move to the outside of the first body 651 via the insertion hole 652, so that the fastener 610 is able to be separated from the second body 655. Accordingly, the state in which the door 200 is locked to the cabinet 10 is released, and the user is able to open the door 200.

Unlike as shown, in the lock 600, locations of the fastener 610 and the coupler 650 may be changed.

In one example, even when the lock 600 is of the push button type, the lock 600 should maintain the locked state of the door when the drum 30 rotates, the water supply 50 supplies water, or the tub 20 contains water.

To this end, the laundry treating apparatus of the present disclosure may further include an actuator 700 that may maintain the locked state of the lock 600.

For example, the actuator 700 may be physically connected to the lock 600 to maintain or release the locked state of the lock 600.

The actuator 700 may include a solenoid 710 that generates an electromagnetic field, and a magnetic component 720 that receives an attraction force by the solenoid 710.

The solenoid 710 may be disposed on the first body 651, and the magnetic component 720 may be disposed on the second body 655.

When the solenoid 710 operates in a first mode that generates the magnetic field, the magnetic component 720 may be fixed in location. Accordingly, even when the door 200 is pressurized or the sensor 240 is pressed, the lock 600 may maintain the locked state of the door.

In one example, the actuator 700 may be controlled such that the lock 600 forcibly unlocks the door 200.

Specifically, when the solenoid 710 operates in a second mode that generates a magnetic field stronger than that of the first mode, the magnetic component 720 may move further toward the solenoid 710. That is, an effect of the coupler 650 being pressurized by the fastener 610 may be derived.

When an unlock command for the lock 600 to unlock the door 200 is transmitted from the control panel 100 or when the command for the lock 600 to unlock the door 200 is delivered via the pressurization of the sensor 240, and when there is no stored water inside the tub 20 while the driver 40, the water supply 50, and the drainage 60 are not operating, the solenoid 710 may operate in the second mode.

In one example, the sensor 240 may be designed to be deactivated from receiving the input when the laundry treating apparatus is operating. Specifically, the sensor 240 may be deactivated from receiving the input in at least one of following situations: the drum 30 is rotating; the tub 20 is being supplied with water; and water is contained inside the tub 20.

That is, the sensor 240 may be deactivated from receiving the opening command in a situation in which the lock 600 is controlled not to unlock the door.

For example, when the sensor 240 is deactivated, the sensor 240 may not react even when the user touches or presses the same, and when the sensor 240 is designed to be able to emit light, the sensor 240 may be turned off.

FIG. 12 shows that an opening angle of the door needs to be restricted.

Because the door 200 has the front surface made of the glass and the component such as the sensor 240 is disposed therein, when the door 200 is opened excessively, it may collide with a wall w.

In the state in which the lock 600 has unlocked the door 200, when the door 200 pivots too easily or is suddenly opened at an angle equal to or greater than 90 degrees when being pulled by the user, the door 200 may collide with an object such as the wall w near the laundry treating apparatus.

When the front surface of the door 200 collides with an external object, there is a high risk that a crack may occur on the front surface 210 of the door or the sensor 240 may be damaged.

Therefore, there is a need to restrict at least one of a rotating angle and a rotating speed of the connector 330 based on the mounting portion 310, or to restrict an angle at which the door 200 arbitrarily pivots at the connector 330.

FIG. 13 shows an embodiment of restricting a rotating angle of the door.

The door 200 may open and close the inlet by rotating to be away from or be closer to the inlet based on the hinge 300.

The door 200 may be constructed to additionally move further away from the inlet after the connector 330 pivots to be withdrawn from the mounting portion 310 as an inner side of the door frame 220 is rotatably coupled also to a distal end of the connector 330.

A stopper 400 may be constructed to additionally connect the connector 330 with the door 200 so as to prevent the door 200 from arbitrarily rotating further at the connector 330. Therefore, the door 200 may be prevented from arbitrarily rotating and colliding with the wall or the like.

FIG. 14 shows a location where the stopper is installed.

The laundry treating apparatus of the present disclosure may further include the stopper 400 that restricts the angle at which the door 200 pivots at the hinge 300.

The stopper 400 may have one side coupled to the connector 330 and the other side coupled to the door frame 220. The stopper 400 may restrict the angle at which the door 200 pivots based on the connector 330.

The stopper 400 may completely fix an arrangement angle of the door 200 and the connector 330. In this case, the rotating angle of the door 200 may be determined only by the rotating angle of the connector 330 with respect to the mounting portion 310. As a result, the door 200 may be prevented from rotating arbitrarily based on the connector 330.

The stopper 400 may allow the door 200 to pivot at the connector 330, but restrict the door 200 from rotating beyond a certain angle on the connector 330.

In this case, the door 200 may pivot more than the angle at which the connector 330 pivots around the mounting portion 310 by an amount permitted by the stopper 400 to open the inlet.

As a result, the door 200 may be prevented from arbitrarily rotating at the connector 330 and colliding with the object located outside. Further, when a great amount of force is required to open the connector 330 from the mounting portion 310, the door 200 may move away from the inlet more easily by the stopper 400, thereby ensuring convenience of the user.

FIG. 15 shows a structure in which the stopper and the hinge are coupled to the door.

The connector 330 of the hinge 300 may be coupled to the door frame 220.

The door frame 220 may pivot together with the connector 330 based on the mounting portion 310.

The door frame 220 may be coupled to the second rotating shaft 322 of the connector 330 and may pivot based on the second rotating shaft 322. That is, the door frame 220 may pivot both clockwise and counterclockwise based on the second rotating shaft 322 at the connector 330.

The stopper 400 may have one side coupled to the connector 330 and the other side coupled to the door 200.

The stopper 400 may pivot only at a certain angle based on the connector 330 or may not pivot at all. As a result, the door frame 220 may be restricted from arbitrarily rotating at the connector 330 by the stopper 400.

The door frame 220 may include a coupling groove 221 where the connector 330 and the stopper 400 are coupled to each other at a side opposite to the fastener 610. The coupling groove 221 may be shielded by a door cover that is coupled to the inner surface of the door frame 220.

The door frame 220 and the door cover shielding the coupling groove 221 may support the hinge 300 and the stopper 400 on both sides. As a result, a coupling force between the door 200 and the hinge 300 may be guaranteed.

The stopper 400 may be installed in a cut area of the connector 330.

The stopper 400 may be fixed to rotating shafts 323 respectively extending from respective distal ends of the third members 333 in a direction in which the third members 333 face each other.

Because the third member 333 is an area located at an outermost portion of the hinge 300, when the stopper 400 is installed on the third member 333, the rotating angle of the door 200 may be controlled most effectively.

The stopper 400 of the present disclosure may include a fixed plate 410 that is coupled to and fixed to the connector 330, a rotating frame 430 that is rotatably disposed on the fixed plate 410 and coupled to the door 200, a cylindrical portion 420 that rotatably supports the rotating frame 430 on the fixed plate 410, and a restricting portion 440 that restricts a rotating angle of the rotating frame 430 on one surface of the cylindrical portion 420.

The fixed plate 410 may be installed in the cut area of the connector 330. A plurality of the fixed plates 410 may be disposed on top and bottom surfaces of the stopper 400, respectively.

The second rotating shaft 322 extending from a lower distal end of the third member 333 disposed on the upper side and the second rotating shaft 322 extending from an upper distal end of the third member 333 disposed on the lower side may be inserted and connected, respectively.

The cylindrical portion 420 may extend in a direction that brings the upper and lower fixed plates 410 closer to each other.

The rotating frame 430 may be coupled to a plurality of the cylindrical portions 420 or the plurality of the fixed plates so as to pivot along an outer circumferential surface of the cylindrical portion 420.

The rotating frame 430 may be coupled to accommodate a portion of a circumference of the cylindrical portion 420 and may be formed in a plate shape that is coupled to the door 200.

The rotating frame 430 may pivot along the circumference of the cylindrical portion 420. Accordingly, the door 200 coupled to the rotating frame 430 may pivot around the third member 333 together with the rotating frame 430.

The restricting portion 440 may be fixedly disposed on a portion of the circumference of the cylindrical portion 420 to prevent the rotating frame 430 from rotating further. When the rotating frame 430 hits the restricting portion 440 while rotating the cylindrical portion 420, further rotating thereof may be prevented.

The restricting portion 440 may be installed at a location on the cylindrical portion 420 that restricts a direction in which the door 200 opens. The angle at which the door 200 pivots may be determined depending on an installation location of the restricting portion 440.

FIG. 16 shows an operation scheme of the stopper.

In the stopper 400, the rotating frame 430 may be coupled to pivot around the circumference of the cylindrical portion 420. In addition, the restricting portion 440 that is fixed to the cylindrical portion 420 at a location in front of the rotating frame 430 and is in contact with the rotating frame 430 may be disposed.

When the rotating frame 430 pivots to be away from the restricting portion 440, the door 200 will pivot toward the inlet at the connector 330, and when the rotating frame 430 pivots to be closer to the restricting portion 440, the door 200 will pivot outward of a side surface of the cabinet to be away from the inlet at the connector 330.

The restricting portion 440 may be positioned at a location farther from the inlet than the rotating frame 430. As a result, the door 200 may pivot at the connector 330 to an extent permitted by the restricting portion 440 to move away from the inlet, and then be restricted from rotating by being caught by the restricting portion 440.

Therefore, even when the door 200 is quickly opened or pulled away from the inlet by the user, further rotating thereof may be prevented.

FIG. 17 shows an embodiment of reducing a rotating speed of the door.

The hinge 300 may further include an elastic body 340 that restricts the rotating speed of the connector 330 with respect to the mounting portion 310.

The elastic body 340 may have one end fixed to the first member 331 and the other end fixed to the door support 312 by winding the first rotating shaft 321.

The elastic body 340 may provide a restoring force for the first member 331 toward the mounting body 311.

Accordingly, when the door 200 is opened, the first member 331 may receive a stronger restoring force the farther away it is from the mounting body 311. Accordingly, a speed at which the first member 331 pivots relative to the door support 312 may be restricted by the elastic body 340, and the door 200 may be prevented from suddenly opening at a high speed. In addition, the door 200 may receive a force to close the inlet by the elastic body 340.

As a result, the door 200 may be prevented from colliding with the wall, the object, or the like disposed on a side of the laundry treating apparatus.

FIG. 18 shows a method in which a door pivots outward of a side surface of the cabinet 10.

Referring to (a) in FIG. 18, the door 200 has closed the inlet, and the connector 330 may be disposed to be accommodated between the door supports 312.

Referring to (b) in FIG. 18, when the door 200 opens the inlet, the connector 330 may pivot from the door supports 312 and begin to be withdrawn outward of the door supports 312.

For example, the connector 330 may pivot clockwise from the door supports 312.

Referring to (c) in FIG. 18, the connector 330 may pivot further and receive a greater restoring force by the elastic body 340. Therefore, the door 200 may not provide a force to further withdraw the connector 330 from the mounting portion 310. Therefore, the connector 330 may stop rotating from the mounting portion 310.

Therefore, the door 200 may be prevented from rotating further outward of an outer side of the cabinet.

Referring to (d) in FIG. 18, when the opening angle of the door 200 has not reached approximately 90 degrees from the inlet, the user may be hindered from putting the laundry into or withdrawing the laundry from the inlet by the door 200.

Therefore, the user may apply a force to further open the door 200. However, the connector 330 may not be able to pivot because of the elastic force provided by the elastic body 340. At this time, the door 200 may further pivot based on the second rotating shaft 322 disposed on the connector 330. As a result, the angle at which the door 200 is opened may be equal to or greater than 90 degrees. That is, a portion of the door 200 may pivot further outward of the side surface of the cabinet 10, thereby exposing more of the inlet.

However, the stopper 400 may restrict the angle at which the door 200 pivots based on the connector 330. Accordingly, the door 200 may pivot on the connector 330 together with the stopper 400 and then may be prevented from rotating further when the stopper 400 stops rotating.

As a result, the door 200 may be restricted from rotating excessively based on the third member and being excessively bent outward of the side surface of the cabinet 10.

That is, the door 200 may be allowed to pivot further at the connector 330 by the stopper 400, but the angle thereof may be restricted.

In summary, the laundry treating apparatus of the present disclosure may prevent damage to the door 200 by additionally installing the elastic body 340 and the stopper 400 on the hinge 300 to prevent rapid opening or excessive opening of the door 200.

The present disclosure may be modified and implemented in various forms, so that the scope of rights thereof is not limited to the above-described embodiments. Therefore, when the modified embodiment includes elements of the claims of the present disclosure, it should be considered to fall within the scope of the present disclosure.

What is claimed is:

1. A laundry treating apparatus comprising:

a cabinet having an inlet defined in a front surface thereof;

a drum disposed inside the cabinet to accommodate laundry therein;

a door rotatably coupled to the cabinet to open and close the inlet;

a lock disposed on the cabinet to selectively lock the door to the cabinet;

a sensor disposed in the door to receive an opening command for the door to open the inlet; and a hinge, wherein the lock is controlled to unlock the door in case that the sensor receives the opening command, wherein the hinge includes:

a mounting portion coupled to the cabinet and supporting the door;

a connector having one side rotatably coupled to the mounting portion and an opposite side coupled to the door to guide rotating of the door;

a stopper having one side coupled to the connector and an opposite side coupled to the door to restrict a rotating angle of the door; and an elastic body coupled to the connector and the mounting portion to adjust a rotating angle of the connector and restrict the rotating angle of the door.

2. The laundry treating apparatus of claim 1, wherein the lock is configured to repeat a process of sequentially locking and unlocking the door whenever the door is pressed toward the inlet.

3. The laundry treating apparatus of claim 1, wherein the sensor is equipped as a touch panel.

4. The laundry treating apparatus of claim 1, wherein the hinge is disposed on one side of the inlet to rotatably fix the door to the cabinet, wherein the lock is disposed on an opposite side of the inlet from the hinge, wherein the sensor is provided to be identifiable on a surface of the door and is disposed upward of the hinge and the lock.

5. The laundry treating apparatus of claim 4, wherein the sensor is disposed closer to the lock than to the hinge.

6. The laundry treating apparatus of claim 4, wherein the sensor is disposed in an area spaced upwardly apart from the hinge with an angle equal to or greater than 90 degrees based on a center of the door, wherein the sensor is disposed in an area spaced upwardly apart from the lock with an angle smaller than 90 degrees.

7. The laundry treating apparatus of claim 4, wherein the sensor is disposed closer to an outer circumferential surface of the door than to a center of the door.

8. The laundry treating apparatus of claim 4, further comprising:

a control panel disposed on the cabinet above the inlet and connected to at least one of the sensor and the lock; and a first cable connecting the sensor with the control panel, wherein the first cable is provided to connect the sensor with the control panel via the hinge.

9. The laundry treating apparatus of claim 8, further comprising a second cable connecting the control panel with the lock.

10. The laundry treating apparatus of claim 1, further comprising:

a control panel disposed on the cabinet upward of the inlet and connected to at least one of the sensor and the lock; and a first cable connecting the sensor with the control panel, wherein at least one of the mounting portion and the connector includes a guide groove where the first cable is accommodated and installed.

11. The laundry treating apparatus of claim 1, further comprising a driver configured to rotate the drum, wherein the sensor is controlled to be deactivated from receiving the opening command in case that the driver operates.

12. The laundry treating apparatus of claim 11, further comprising:

a tub accommodating therein the drum inside the cabinet; and a water supply valve configured to supply water to the tub, wherein the sensor is controlled to be deactivated from receiving the opening command when the water supply valve is opened.

13. The laundry treating apparatus of claim 1, further comprising an executor disposed above the inlet and configured to receive an execution command to execute a course for treating the laundry, wherein in case that the executor is pressed, the lock maintains the door in a locked state even when the sensor receives the opening command.

* * * * *